US005565973A

United States Patent [19]

Fujishiro et al.

[11] Patent Number: 5,565,973

[45] Date of Patent: Oct. 15, 1996

[54] ROTARY DEVELOPING DEVICE FOR AN IMAGE FORMING APPARATUS

[75] Inventors: Takatsugu Fujishiro, Tokyo; Hiroyuki Matsushiro, Yokohama; Noriyuki Kimura, Kawasaki; Katsuhiro Aoki, Yokohama; Yuichi Ueno, Kawasaki; Chiyako Kobayashi, Tokyo; Minoru Suzuki; Tomoji Ishikawa, both of Yokohama, all of Japan

[73] Assignee: Ricoh Company, Ltd., Tokyo, Japan

[21] Appl. No.: 420,058

[22] Filed: Apr. 11, 1995

[30] Foreign Application Priority Data

| | | | |
|---|---|---|---|
| Apr. 11, 1994 | [JP] | Japan | 6-098125 |
| May 27, 1994 | [JP] | Japan | 6-138193 |
| Mar. 15, 1995 | [JP] | Japan | 7-083384 |

[51] Int. Cl.[6] ..... G03G 15/01

[52] U.S. Cl. ..... 355/326 R; 355/208; 355/210; 355/260; 355/327

[58] Field of Search ..... 355/326 R, 327, 355/260, 208, 203, 210, 200, 245; 222/DIG. 1; 141/363, 365; 353/204

[56] References Cited

U.S. PATENT DOCUMENTS

| | | | |
|---|---|---|---|
| 4,615,612 | 10/1986 | Ohno et al. | 355/245 |
| 4,620,783 | 11/1986 | Tanaka et al. | 355/245 X |
| 4,697,915 | 10/1987 | Hayashi et al. | 355/327 X |
| 4,821,075 | 4/1989 | Saito et al. | 355/209 |
| 4,922,301 | 5/1990 | Katoh et al. | 355/326 R X |
| 4,939,548 | 7/1990 | Yamada et al. | 355/245 |
| 5,109,254 | 4/1992 | Oka et al. . | |
| 5,115,275 | 5/1992 | Suzuki . | |
| 5,168,319 | 12/1992 | Kimura et al. | 355/326 R |
| 5,172,169 | 12/1992 | Takashima et al. . | |
| 5,198,866 | 3/1993 | Kimura et al. | 355/326 R |
| 5,239,344 | 8/1993 | Enoki et al. . | |
| 5,283,613 | 2/1994 | Midgley, Sr. | 355/203 |
| 5,286,918 | 2/1994 | Iwata et al. . | |
| 5,311,263 | 5/1994 | Suzuki et al. . | |
| 5,315,061 | 5/1994 | Suzuki et al. . | |
| 5,325,151 | 6/1994 | Kimura et al. | 355/200 |
| 5,331,390 | 7/1994 | Kimura et al. . | |
| 5,339,141 | 8/1994 | Suzuki et al. . | |
| 5,416,568 | 5/1995 | Yoshiki et al. . | |
| 5,471,292 | 11/1995 | Okazawa | 355/326 R |

FOREIGN PATENT DOCUMENTS

| | | |
|---|---|---|
| 2-16578 | 1/1990 | Japan . |
| 3-210573 | 9/1991 | Japan . |
| 5-66668 | 3/1993 | Japan . |
| 5-265274 | 10/1993 | Japan . |
| 6-19308 | 1/1994 | Japan . |
| 6-314028 | 11/1994 | Japan . |

*Primary Examiner*—Matthew S. Smith

*Attorney, Agent, or Firm*—Oblon, Spivak, McClelland, Maier & Neustadt, P.C.

[57] ABSTRACT

In an image forming apparatus, a rotary developing device effects development by revolving a plurality of developing sections around a rotary shaft until any one of them reaches a developing position where it faces an image carrier. Cartridges are respectively mounted to hoppers included in the developing sections. Guides are provided on the inner periphery of each cartridge in order to guide toner, moving due to the revolution or the developing device, toward a toner outlet formed in the cartridge. Even when the amount of toner remaining in the cartridge is small, the entire toner is replenished into the associated hopper and fully consumed.

11 Claims, 27 Drawing Sheets

ROTARY DEVELOPING DEVICE FOR AN IMAGE FORMING APPARATUS

BACKGROUND OF THE INVENTION

1. Field of the Invention

The present invention relates to a copier, facsimile apparatus, printer or similar image forming apparatus and, more particularly, to a rotary developing device included in an image forming apparatus and of the type effecting development after causing a plurality of developing sections to revolve around a rotary shaft until one of them reaches a developing position where it faces an image carrier.

2. Discussion of the Background

There has been known a full-color copier or similar full-color image forming apparatus of the type exposing an image carrier to color-separated light images to thereby form corresponding latent images, developing each latent image by toner of complementary color, and transferring the resulting toner images to a paper one above the other. There has also been known a multicolor image forming apparatus of the type exposing an image carrier to images to be reproduced in respective colors, developing the resulting latent images by developers of respective colors to thereby produce corresponding toner images, and transferring the toner images to a paper one above the other. This kind of image forming apparatus needs a plurality of developing sections each being assigned to a particular color. However, when the developing sections are implemented as independent units and arranged around the image carrier, the overall dimensions of the apparatus increase.

In light of the above, a rotary developing device having a plurality of developing sections constructed into a single revolver has been developed. The developing device, or revolver, is located in the vicinity of an image carrier and is revolved to sequentially bring the developing sections to a developing position where they face the image carrier. Each developing section located at the developing section develops a latent image formed on the image carrier by toner of particular color. In a revolver disclosed in Japanese Patent Laid-Open Publication No. 60-233668 (Document 1), for example, a hollow toner supply member is disposed in each developing section to extend in the lengthwise direction. The supply member is formed with a toner outlet in the peripheral wall thereof. Such supply members each store toner to be supplied to the respective developing section. Fresh toner storing portions, independent of the developing sections, are each connected to one of the supply members by a flexible tube. A screw or similar flexible conveyor member is disposed in the toner storing portion and tube in order to convey the toner from the respective toner storing section to the associated developing section. Japanese Patent Laid-Open Publication No. 63-153258 (Document 2) teaches a revolver having developing sections each storing toner of a particular color. In this revolver, a hopper is positioned in the vicinity of a developer carrier disposed in each developing section. When the revolver revolves, a predetermined amount of developer is introduced into the hopper.

However, the revolver proposed in Document 1 nee d s drive means for driving the conveying member for conveying the toner from the fresh toner storing portion to the associated developing section, complicating the construction and increasing the cost. Moreover, the mechanical force of the conveying member constantly acts on the toner being fed from the storing section to the developing section, accelerating the deterioration of the toner. The revolver of Document 2 has a drawback that the overall dimensions increase when a great amount of toner is stored in each developing section beforehand. Another drawback is that when the toner is irregularly distributed in the axial direction of the developer carrier due to the repeated operation of the developing section, the revolution cannot level the amount of toner alone. As a result, an image with irregular density is apt to occur despite that a sufficient amount of toner is present in the hopper.

To eliminate the above problems, a revolver having hoppers at, for example, one end of respective developing units has been proposed. Toner containers, each storing toner of a particular color, are removably mounted to and communicated to the respective hoppers. The toner in each container is replenished into the associated hopper by the revolution of the revolver. The supply of toner from the hopper to the associated developing section and the collection of excessive toner from the latter to the former are implemented by a screw or similar conveying means. This kind of revolver can replenish fresh toner from container into the associated hopper without resorting to a mechanical conveying mechanism. Further, the toner is not directly stored in the developing section, but it is stored in the hopper and container. Hence, the developing section and, therefore, the entire revolver is miniature.

Japanese Patent Laid-Open Publication Nos. 62-15572 and 62-251772 each disclose a revolver having a hopper at the end of each developing section. In this revolver, a screw or similar conveying means, as well as other members, is driven by common drive means without the intermediary of the flexible tube or similar long conveyance path, thereby conveying toner from the hopper to the associated developing section. This successfully stabilizes the amount of toner in the axial direction and, therefore, on the developer carrier, and reduces the sectional occupancy ratio of the revolver relative to the image carrier.

To make the hoppers and fresh toner containers miniature and store a great amount of toner in each of them, it is preferable that the containers mounted to the hoppers be provided with a generally circular contour concentric with the center of rotation of the revolver, as seen in the lengthwise direction of the developing sections. However, this kind of approach has a problem that only the toner passing over the portion where the container is connected to the hopper is replenished into the hopper during the revolution of the revolver. This is also true when the amount of toner remaining in the container is small. In this condition, the toner is apt to partly remain in the container without being consumed.

A current trend in the imaging art is toward a photoconductive element and a developing device, among others, implemented as units which can be replaced by the user. There has been developed a revolver replaceable as a developing unit, as taught in Japanese Patent Laid-Open Publication No. 63-78170 by way of example. However, handling this kind of revolver storing toner as a unit brings about various problems. For example, in the event of transport, the developing unit is heavy and contaminates, when broken, the surrounding by causing the toner to fly about. In addition, the toner is apt to smear the user's hands and cloths in the event of replacement of the developing unit.

SUMMARY OF THE INVENTION

It is, therefore, an object of the present invention to provide a rotary developing device capable of surely replenshing powdery developer into each hopper even when the amount of developer remaining in a container is small, thereby allowing the entire developer in the container to be consumed.

It is another object of the present invention to provide an image forming apparatus having a removable rotary developing device not containing developer therein and which is, therefore, easy to handle in the event of transport and replacement by the user.

In accordance with the present invention, a rotary developing device has a plurality of developing sections arranged around a rotary shaft. A plurality of hoppers are respectively constructed integrally with and communicated to the developing sections, and respectively store powdery developers to be supplied to the developing sections. A plurality of developer containers are respectively removably mounted to and communicated to the hoppers, and respectively contain powdery developers to be replenished into the hoppers. A plurality of guide portions are respectively provided in the developer containers and guide, when the developing sections are revolved, the powdery developers to outlets respectively formed in the toner container. The developing sections are revolved around the rotary shaft until any one of the developing sections reaches a developing section where it faces an image carrier, while the powdery developer is replenished from one of the plurality of developer containers into the respective hopper due to the revolution of the developing sections.

Also, in accordance with the present invention, a rotary developing device has a plurality of developing sections arranged around a rotary shaft. A plurality of hoppers are respectively constructed integrally with the developing sections and respectively communicated to the developing sections in the lengthwise direction of the developing sections. Each hopper stores a powdery developer to be supplied to the respective developing section. A supply member supplies a developer carrier with a developer from a first conveying region for supply formed in the lengthwise direction of each developing sections. A conveying device conveys the developer from the respective hopper to the respective first conveying region, and returns to the respective hopper a developer collected in a second conveying region for collection, which is separated from the first conveying region, without being deposited on the developer carrier. The developing sections are revolved around the rotary shaft until one of the developing sections reaches a developing position where it faces an image carrier. The developing device is operable in an initial start-up mode for driving the conveying device, while maintaining the supply member inoperative, such that the developer replenished into the respective hopper is conveyed over the entire dimension of the first conveying region.

Further, in accordance with the present invention, in an image forming apparatus having a rotary developing device having a plurality of developing sections arranged around a rotary shaft, and for effecting development by revolving the developing sections until any one of the developing sections reaches a developing position where it faces an image carrier, the developing device is removably mounted to the body of the image forming apparatus. A distinguishing device is provided for determining whether or not the developing device mounted to the image forming apparatus is new and contains no developers in the developing sections.

Moreover, in accordance with the present invention, in an image forming apparatus having a rotary developing device having a plurality of developing sections arranged around a rotary shaft, and for effecting development by revolving the developing sections until any one of the developing sections reaches a developing position where it faces an image carrier, the developing device is removably mounted to the body of the image forming apparatus. A mark indicative of the reference position of the developing device is implemented by a bar code label representative of information for identification and adhered to the developing device. A sensor responsive to the reference position is provided and implemented by a bar code reader capable of reading the bar code label.

BRIEF DESCRIPTION OF THE DRAWINGS

The above and other objects, features and advantages of the present invention will become apparent from the following detailed description taken with the accompanying drawings in which:

FIG. 17B is a perspective view associated with FIG. 17B;

DESCRIPTION OF THE PREFERRED EMBODIMENTS

Preferred embodiments of the rotary developing device in accordance with the present invention will be described together with image forming apparatuses implemented thereby.

1st Embodiment

Figure 1:
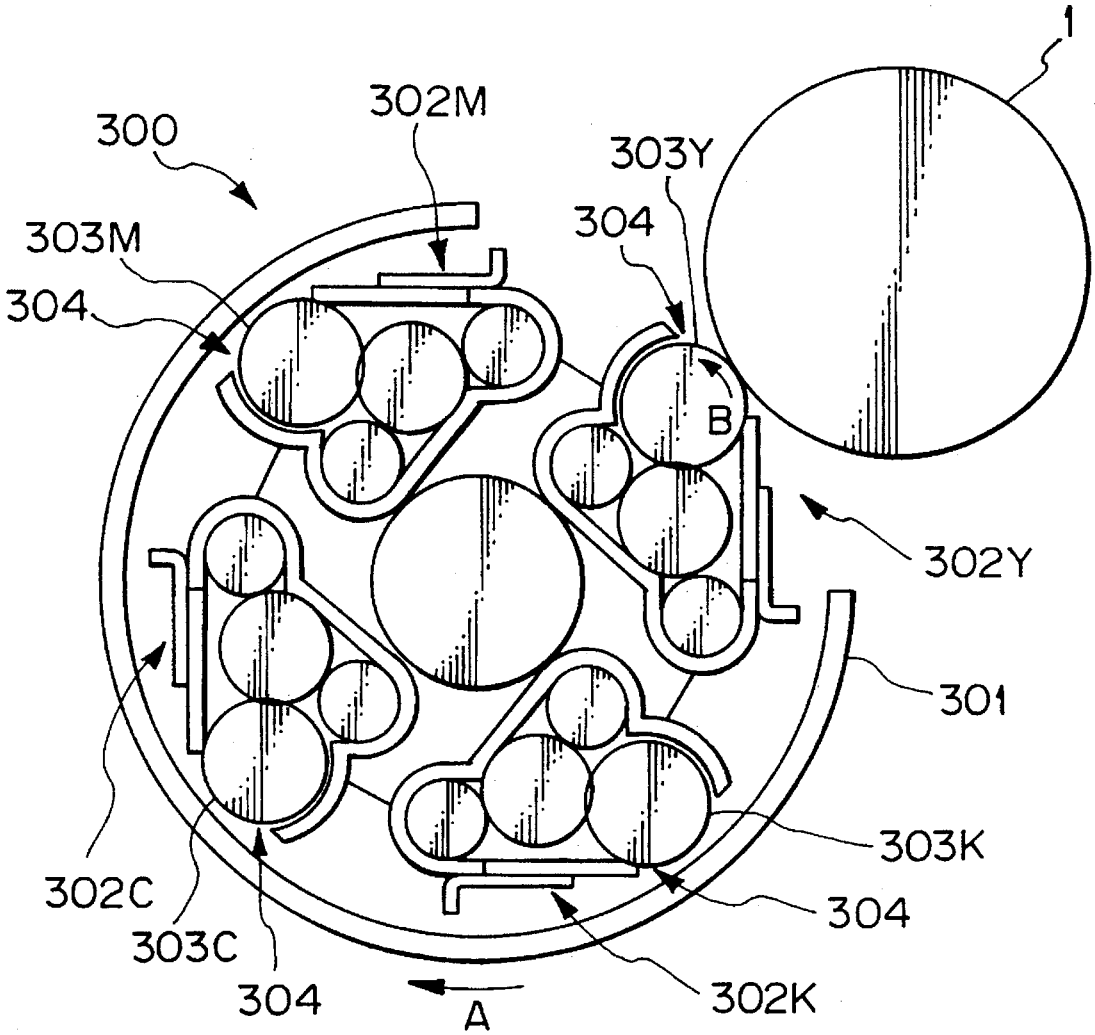
FIG. 1 is a section showing a rotary developing device embodying the present invention.

Referring to FIG. 1 of the drawings, a first embodiment of the present invention is shown and applied to a copier, facsimile apparatus, printer or similar image forming apparatus. FIG. 1 shows a specific condition wherein one developing section, e.g., a yellow developing section, which will be described, is located at a developing position. As shown, a rotary developing device, or revolver, 300 is located in the vicinity of a photoconductive element implemented as a drum 1. The revolver 300 has a casing 301 having a yellow developing section 302Y, a magenta developing section 302M, a cyan developing section 302C, and a black developing section 302K. The revolver 300 is rotated about its own axis by a drive mechanism, not shown, in a direction indicated by an arrow A by way of example. The revolver 300, therefore, brings one of the developing sections 302Y–302K to a developing position where it faces the drum 1.

The developing sections 302Y–302K respectively store yellow toner, magenta toner, cyan toner, and black toner which are nonmagnetic developers not accompanied by carrier. Each of the developing sections 302Y–302K deposits the respective toner on a latent image electrostatically formed on the drum 1, thereby producing a corresponding toner image. Developing rollers, or developer carriers, 303Y, 303M, 303C and 303K are included in the developing sections 302Y, 302M, 302C and 302K, respectively. The rollers 303Y–303K are each partly exposed to the outside through an opening 304 formed in the associated developing section.

When one of the developing sections 302Y–302K is brought to the developing position, the roller 303Y, 303M, 303C or 303K thereof is rotated in a direction B to develop one of latent images sequentially formed on the drum 1. The resulting toner images are transferred to a paper one above the other to complete a full-color image.

The developing sections 302Y–302K, which will be described specifically hereinafter, have an identical configuration and operate in the same manner. Let the following description concentrate on the yellow developing section 302Y by way of example. The same constituents of the sections 302Y–302K are simply distinguished by the suffix.

Figure 2A:
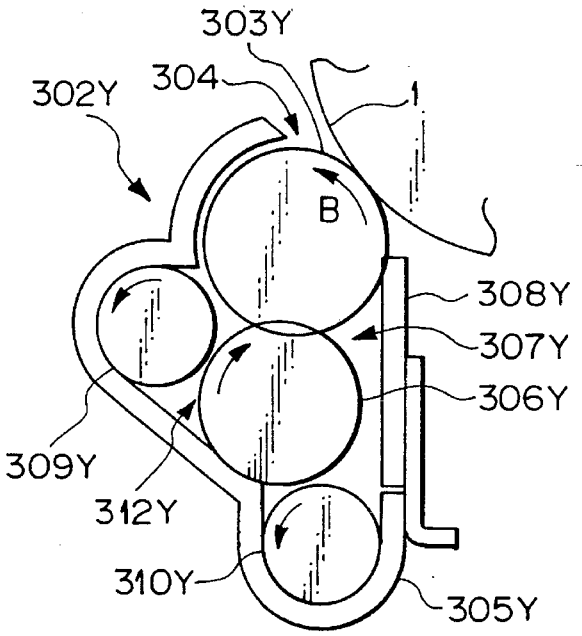
FIG. 2A is a section of a developing section included in the embodiment.

As shown in FIG. 2A, the developing section 302Y is positioned below the drum 1 during development and supplies the yellow toner to a latent image formed on the drum 1. The section 302Y has a casing 305Y which is formed with an opening 304 in an upper portion thereof, as seen at the developing position. The roller 303Y is positioned in t h e opening 304 to face the drum 1. The roller 303Y is rotatable with a predetermined peripheral speed ratio to the drum 1 and movable in the same direction as the drum 1, as seen at the developing position. A supply roller, or toner supply member, 306Y is made of foam polyurethane or similar elastic material and held in contact with the developing roller 303Y below the roller 303Y. The supply roller 306Y is rotatable with a predetermined peripheral speed ratio to the developing roller 303Y and movable in the same direction as the roller 303Y, as seen at a position 307Y where the rollers 303Y and 306Y contact. A blade 308Y is made of urethane rubber or a similar elastic material and located in the vicinity of the opening 304 and downstream of the supply roller 306Y with respect to the direction of rotation of the developing roller 303Y. The free end of the blade 308 is held in contact with the roller 303Y.

A first toner conveying member in the form of a screw 309Y is located at the left of the position 307Y in order to convey the toner from the front to the rear in a direction perpendicular to the sheet surface of FIG. 2A. A second toner conveying member in the form of a screw 310Y is located below the supply roller 306 and conveys the toner from the rear to the front in the above-mentioned direction. The screws 309Y and 310Y will be described in detail later.

Figure 2B:
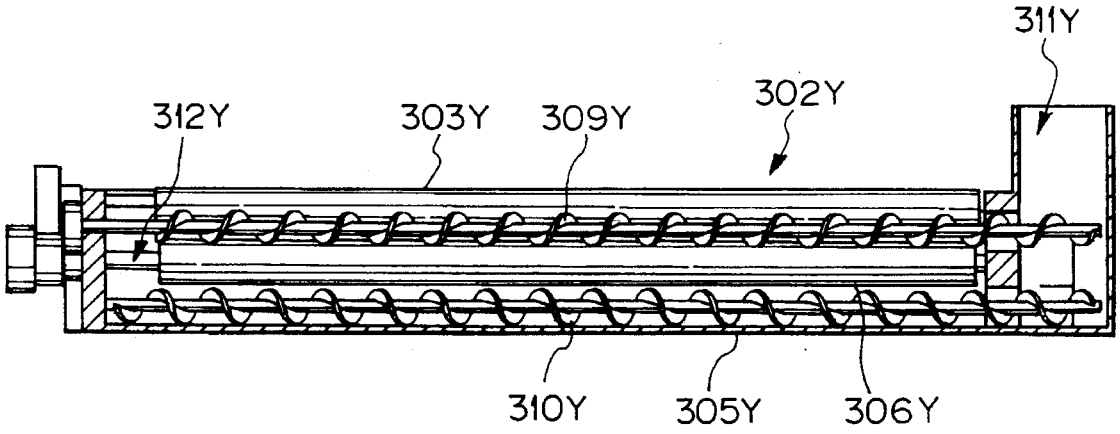
FIG. 2B shows the general configuration of the developing section.
Figure 3:
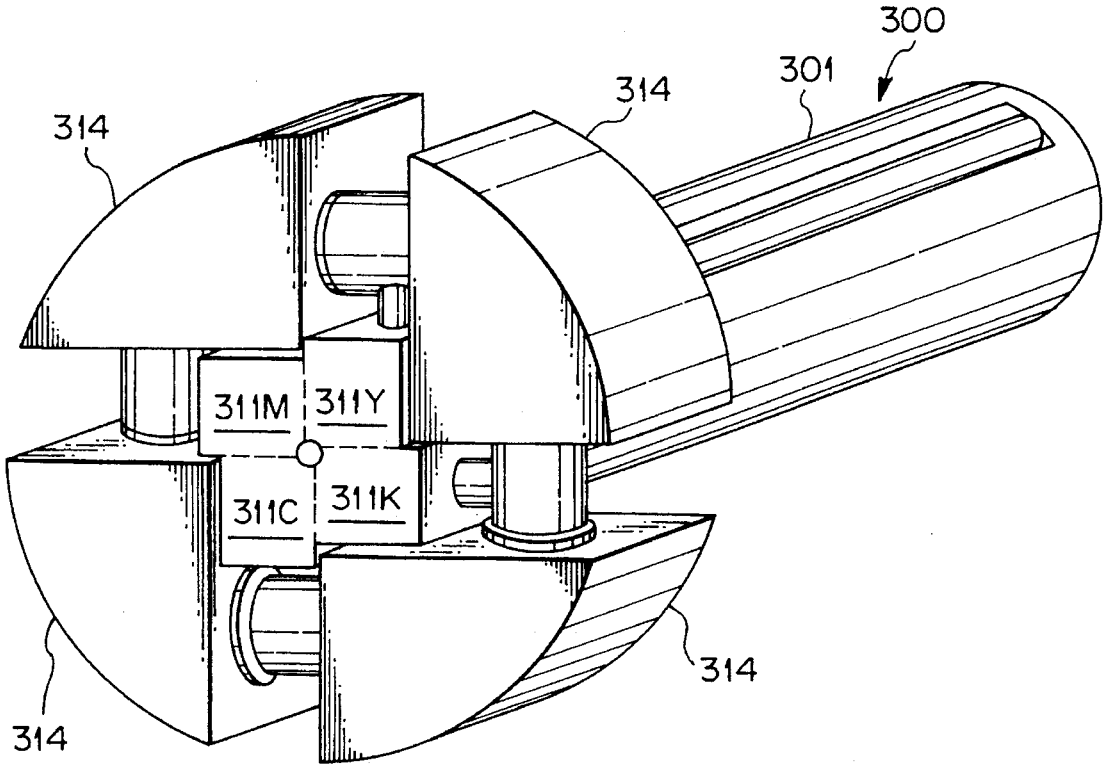
FIG. 3 is an external perspective view of the embodiment.

As shown in FIG. 2B and 3, a toner hopper 311Y is positioned at one end of the developing unit 302Y. The first screw 309Y extends from the hopper 311Y to the other end of the section 302Y in parallel to the rollers 303Y and 306Y. The screw 309Y is rotated in association with the rollers 303Y and 306Y and with a predetermined peripheral speed ratio thereto, conveying the toner from the hopper 311Y to the other end of the section 302Y. As shown in FIG. 2A, the casing 305Y is so configured as to partly contact the roller 306Y. The rollers 303Y and 306Y and casing 305Y define a space 312Y around the screw 208Y.

The toner conveyed from the hopper 311 to the space 312Y by the screw 309Y is fed to the supply roller 306Y. The supply roller 306Y supplies the toner to the developing roller 303Y while rubbing it between the rollers 306Y and 303Y at the position 307Y. As a result, the toner is deposited on the roller 303Y by being electrostatically charged. While the roller 303Y conveys the toner, the blade 308Y levels the toner to form a thin toner layer having a predetermined thickness. The roller 303Y develops a latent image formed on the drum 1 with the thin toner layer by conventional contact or non-contact development.

Part of the toner not used in the developing step is conveyed by the screw 310Y to the other end of the section 302Y remote from the hopper 311Y. As shown in FIG. 2B, a circulating portion 312Y is positioned at the end remote from the hopper 311Y and outside of the effective diameter portions of the rollers 303Y and 306Y in the axial direction. The toner conveyed to the circulating portion 312Y by the screw 309Y is dropped to the bottom of the section 302Y by gravity.

The second screw 310Y is positioned in the lower portion of the section 302Y in parallel to the rollers 303Y and 306Y and screw 309Y. The screw 310Y is rotated to return the toner not used in the developing step to the hopper 311Y. By adequately selecting the amounts of toner to be conveyed by the screws 309Y and 310Y, it is possible to supply the toner to the roller 306Y without sensing the amount of toner in the section 302Y and without resorting to complicated control over the toner supply. In addition, this kind of configuration implements a miniature revolver having considerable freedom of layout and having a small sectional occupancy ratio relative to the drum 1.

As shown in FIG. 3, toner cartridges, or fresh toner containers, 314 are respectively mounted to the developing sections 302Y–302K and are provided with an identical configuration. Specifically, the toner cartridges 314 are each mounted to one of the hoppers 311Y–311K in a direction perpendicular to the axis of the revolver 300. In this condition, each cartridge 314 replenishes fresh toner into one of the hoppers 311Y–311K from above.

Figure 4A:
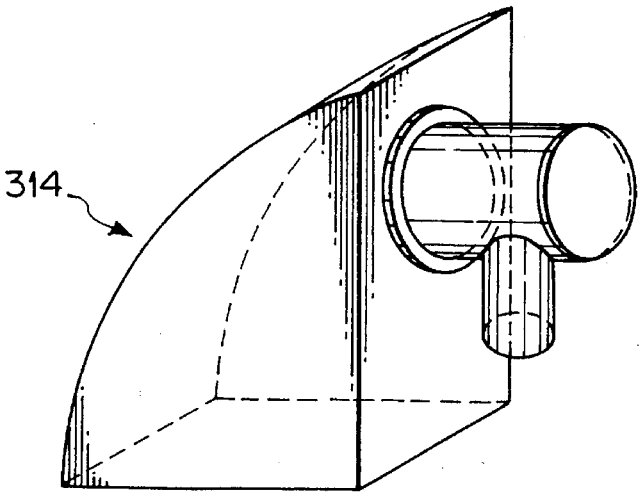
FIG. 4A is a perspective view of a toner cartridge included in the embodiment and removed from a hopper.

The toner cartridges 314 will be described specifically with reference also made to FIGS. 4A and 4B. Each cartridge 314 has a quadrantal section in a plane perpendicular to the axis of the revolver 300. When all the quadrantal cartridges 314 are mounted to the hoppers 311Y–311K, as shown in FIG. 3, their contours form a circle concentric with the center of rotation of the revolver 300.

Figure 4B:
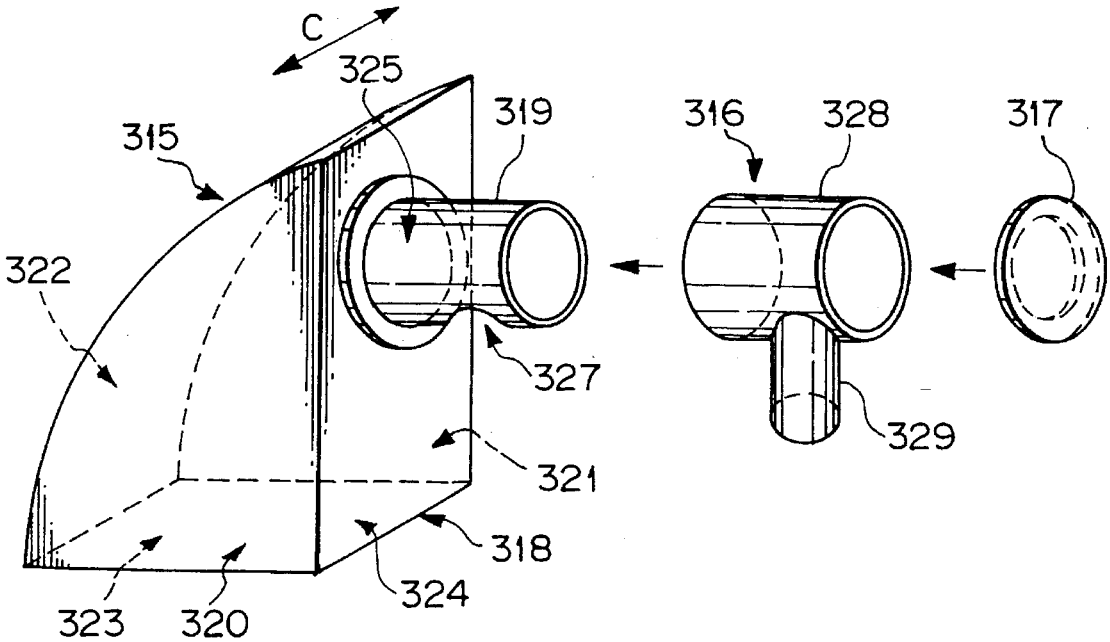
FIG. 4B is an exploded perspective view of the cartridge.
Figure 5:
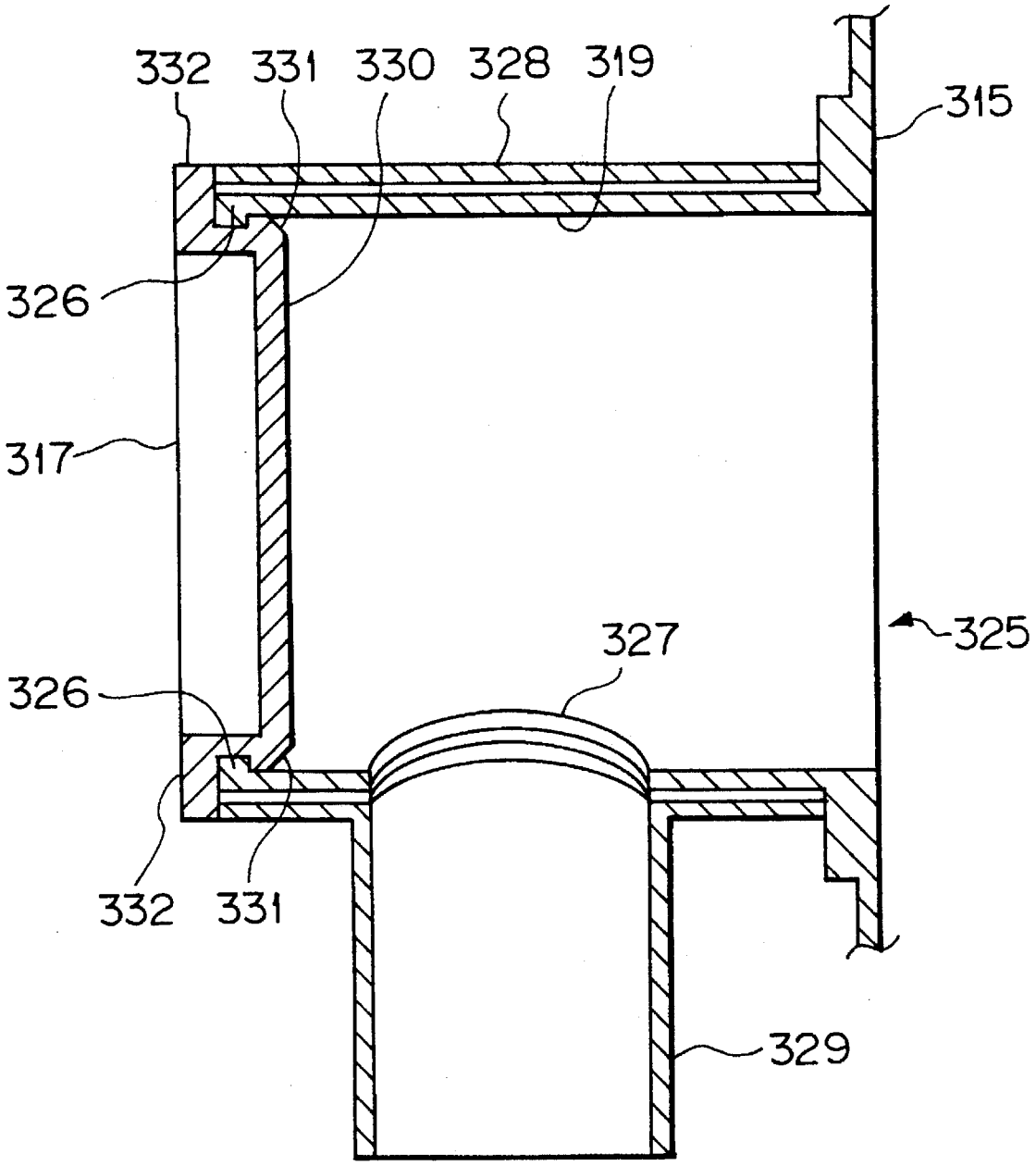
FIG. 5 is a section of a toner passage formed in the cartridge.

As shown in FIG. 4B, each cartridge 314 has a body 315, a connecting member 316, and a cap 317. The body 315 is made up of a toner containing portion 318 and a tubular portion 319. The toner containing portion 318 is defined by opposite quadrantal end walls 320 and 321, a circumferential wall 322 connecting the end walls 320 and 321, and flat walls 323 and 324 also connecting the end walls 320 and 321. A toner outlet 325 is formed in the flat wall 324 at the center in the axial direction of the revolver 300, i.e., in a direction indicated by an arrow C in FIG. 4B. The outlet 325 has a diameter smaller than the distance between the end walls 320 and 321. The tubular portion 319 protrudes from the edge of the outlet 325. A lug 326 (see FIG. 5) protrudes from the inner periphery of the free end of the tubular portion 319. A toner outlet 327 is formed in the bottom of the tubular portion 319, as viewed in FIG. 4B. The connecting member 316 is made up of a tubular portion 328 having an inside diameter greater than the outside diameter of the tubular portion 319, and a branch 329 extending from the tubular portion 328 perpendicularly to the axis of the portion 328. As shown in FIG. 5 in detail, the cap 317 has a coupling portion 330 engageable with the tubular portion 319 of the body 315, a lug 331 formed on the outer periphery, and a flange 332 having a greater diameter than the coupling portion 330.

As shown in FIG. 5, the tubular portion 319 of the body 315 is inserted in the tubular portion 328 of the connecting member 316. In this condition, the connecting member 316 is rotatable relative to the body 315. The coupling portion 330 of the cap 317 is coupled over the tubular portion 319 of the body 315 with the lug 331 mating with the lug 326. The cap 317, removably fitted on the tubular portion 319, restricts the movement of the connecting member 316 in the axial direction of the tubular portion 328 with the flange 332 thereof. When the cartridge 314 is mounted to the toner hopper 311, as shown in FIG. 3, the branch 329 and outlet 327 are aligned with each other. In this condition, the toner stored in the containing portion 318 can freely flow out via the branch 329. When the branch 329 and outlet 327 are not aligned, the cartridge 314 is hermetically closed and prevents the toner from flowing out.

The cartridge 314 having the above configuration is mounted to the hopper 311 with the branch 329 received in a hole, not shown, which is formed in the top of the hopper 311. The hole of the hopper 311 is provided with a shutter mechanism (not shown). When the cartridge 314 is not mounted to the hopper 311, the shutter mechanism constantly closes the hole.

Figure 6A:
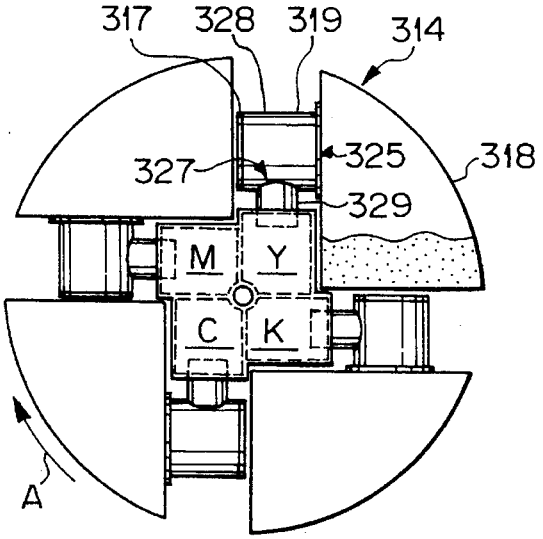
FIGS. 6A–6D demonstrate how a toner is replenished from the cartridge into the hopper.

How the toner is replenished into the hopper 311 from the cartridge 314 is as follows. The cartridge 314 set on the hopper 311 revolves together with the revolver 300. FIG. 6A shows a condition wherein the yellow developing section 302Y is located at the developing position. Assume that the revolver 300 rotates from the position of FIG. 6A to a position of FIG. 6D where the section 302Y is remote from the developing position, by way of positions shown in FIGS. 6B and 6C. Then, the toner of the cartridge 314 sequentially moves in the toner containing portion 318 due to gravity. In the position shown in FIG. 6D, the toner fills the tubular portion 319 of the body 315 as well as the portion adjoining the hopper 311Y. When the revolver 300 further rotates from the position of FIG. 6D to the position of FIG. 6A where the section 302Y is again brought to the developing position, the toner filling the portion 319 is dropped into the hopper 311Y. Hence, the cartridge 314 can replenish the toner into the hopper 311 without resorting to any toner conveying member therein.

Figure 7A:
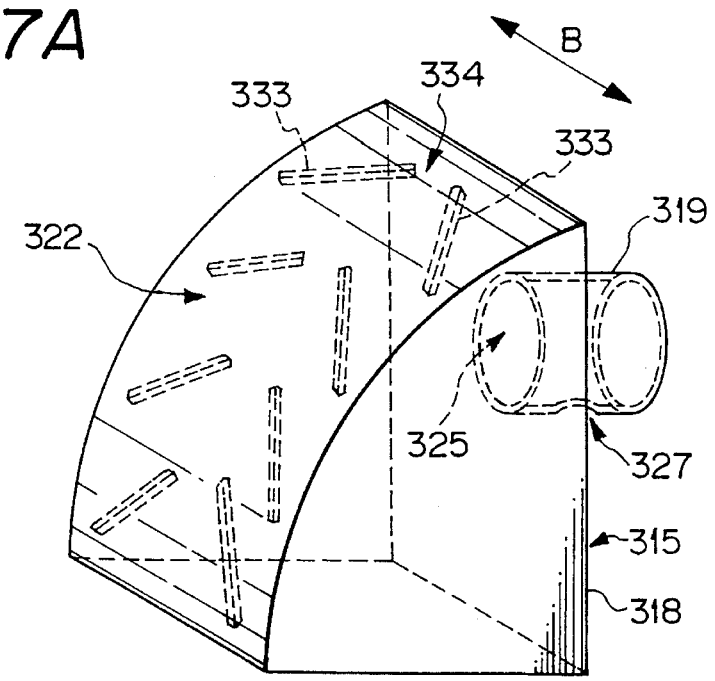
FIG. 7A shows the general configuration of guides included in the embodiment.

However, the above configuration causes only part of the toner filling the tubular portion 319 via the inlet 325 to be replenished into the hopper 311 when the revolver 300 revolves. Therefore, it is likely that the toner not introduced into the outlet 325 remains in the toner containing portion 318 without being consumed. In light of this, as shown in FIG. 7A, guides 333 are provided on the inner periphery of the containing portion 318 in such a manner as to guide the toner, moving due to the revolution of the revolver 300, toward the outlet 325. Specifically, a plurality of pairs of flat guides 333 are provided on the inner periphery of the circumferential wall 322 of the body 315. The guides 333 in each pair are positioned such that their distance sequentially decreases from the upstream side toward the downstream side in the direction in which the toner moves during the revolution of the revolver 300. The downstream portions 334 of each pair of guides 333 are located at substantially the center in a direction B, FIG. 7A, such that the toner being guided by the guides 333 moves toward the outlet 325.

Figure 7B:
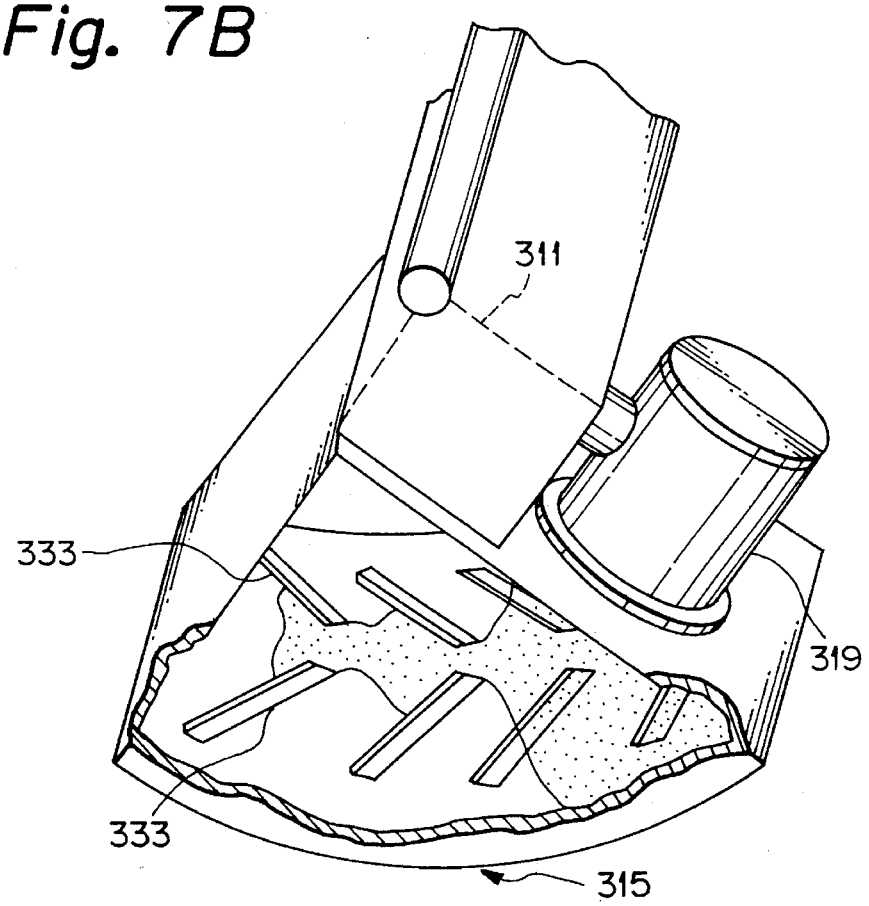
FIG. 7B is a partly taken away perspective view of the cartridge.

Even when the amount of toner remaining in the containing portion 318 is small, the toner existing at opposite ends of the portion 318 in the direction B, FIG. 7A, flows toward the outlet 325 along the guides 333 (see FIG. 7B). As a result, this part of toner is introduced into the hopper 311 via the outlet 325 and tubular portion 319. This allows the toner existing in the containing portion 318 to be fully consumed.

2nd Embodiment

Figure 8A:
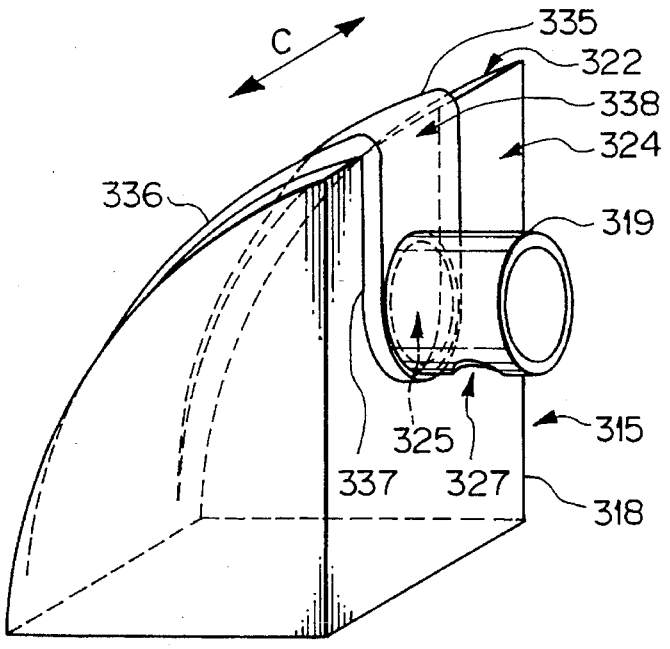
FIG. 8A shows another specific configuration of the guides.

Another specific configuration for allowing the entire toner of the containing portion 318 to be consumed will be described. As shown in FIG. 8A, the circumferential wall 322 and flat wall 323 of the body 315 are partly protruded to the outside to form a continuous guide channel 335 in the inner periphery of the body 315. The width of the guide channel 335, as measured at least on the circumferential wall 336 in a direction C, sequentially decreases from the upstream side to the downstream side in the direction in which the toner moves on the circumferential wall 322 during the revolution of the revolver 300. At the end of the flat wall 337, the guide channel 335 has a width substantially equal to the diameter of the tubular portion 319. In this embodiment, the tubular portion 319 is positioned at the end portion of the wall 337.

Figure 6B:
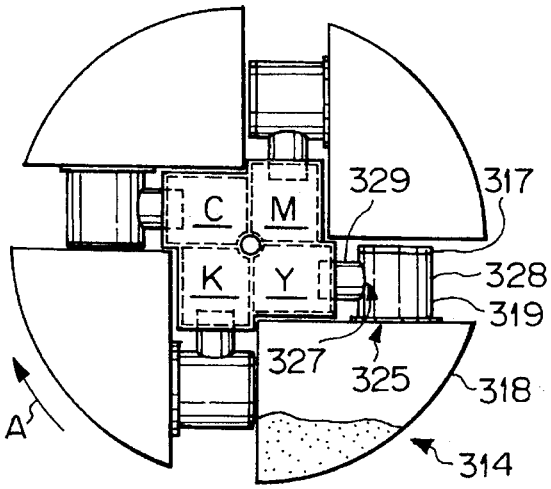
Figure 6C:
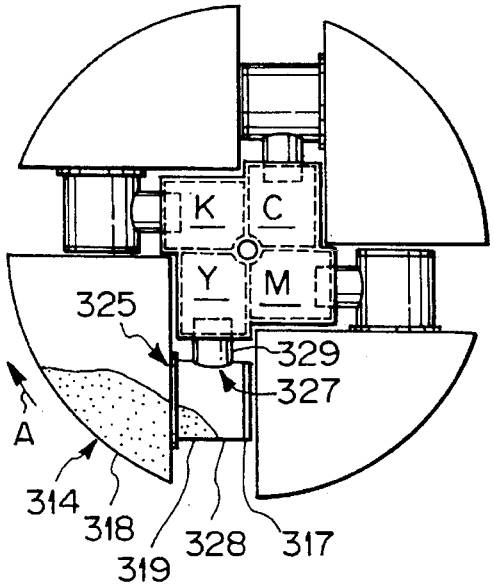
Figure 6D:
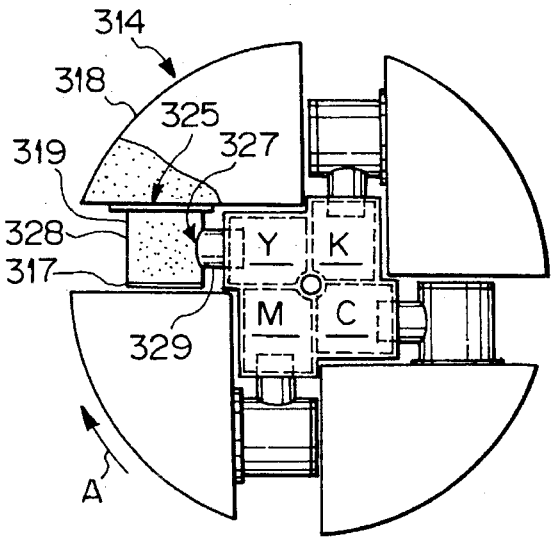
Figure 8B:
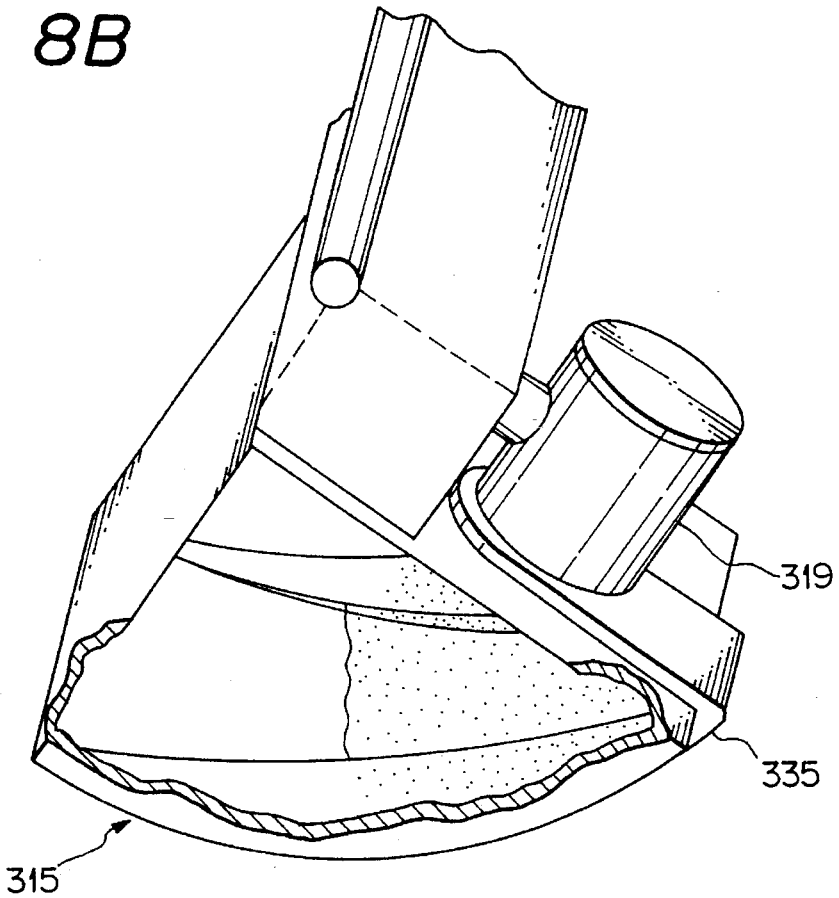
FIG. 8B is a partly taken away perspective view associated with FIG. 8A.

In the above configuration, the toner entering the guide channel 335 in the conditions of FIGS. 6B and 6C is guided by the channel 335 to the vicinity of the outlet 325 (see FIG. 8B). When the cartridge 314 revolves from the position of FIG. 6D to the position of FIG. 6A together with the revolver 300, the toner is transferred to the tubular portion 319 and then to the hopper 311. Even when the amount of toner remaining in the containing portion 318 is small, the channel 335 catches all the toner flowing along the wall 322 and guides it to the vicinity of the outlet 325 due to the movement of the cartridge 314. As a result, the entire toner can be consumed.

Figure 9A:
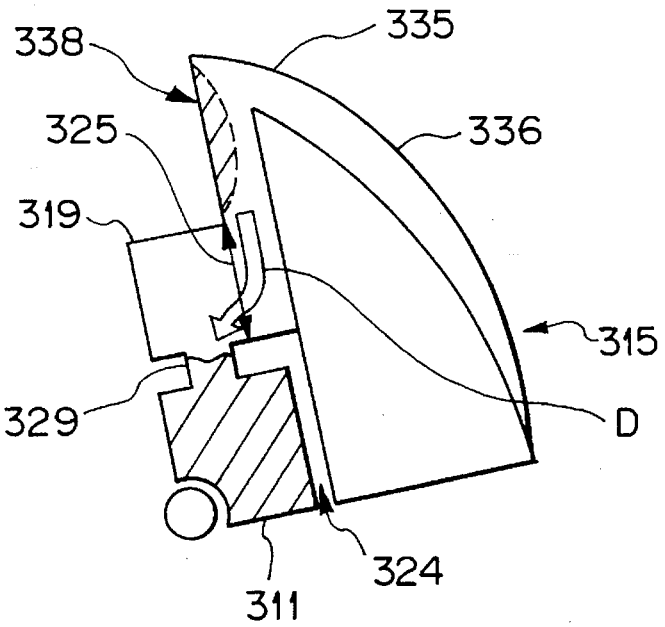
FIG. 9A indicates the flow of toner in the cartridge shown in FIG. 8A.
Figure 9B:
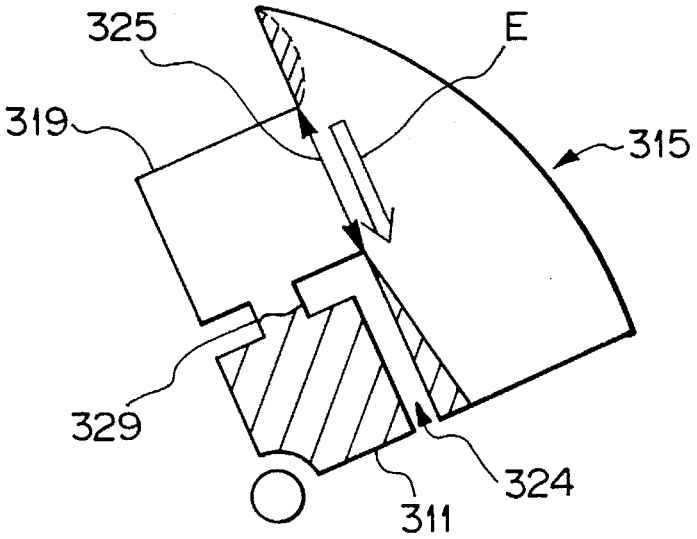
FIG. 9B shows toner passing a toner outlet.

Further, in the embodiment, the channel 335 protrudes outward from the containing portion 318. Hence, the inner periphery of the wall 324 is higher in level than the bottom 338 of the wall portion 337 of the channel 335. It follows that the toner flowing in the containing portion 318 due to the revolution is prevented from passing the outlet 325 due to the step formed between the bottom 338 of the channel 335 and the wall 324. That is, the toner is surely introduced into the outlet 325, as indicated by an arrow D in FIG. 9A. FIG. 9B shows a contrastive configuration which causes the toner to pass the inlet 325, as indicated by an arrow E.

3rd Embodiment

Figure 10:
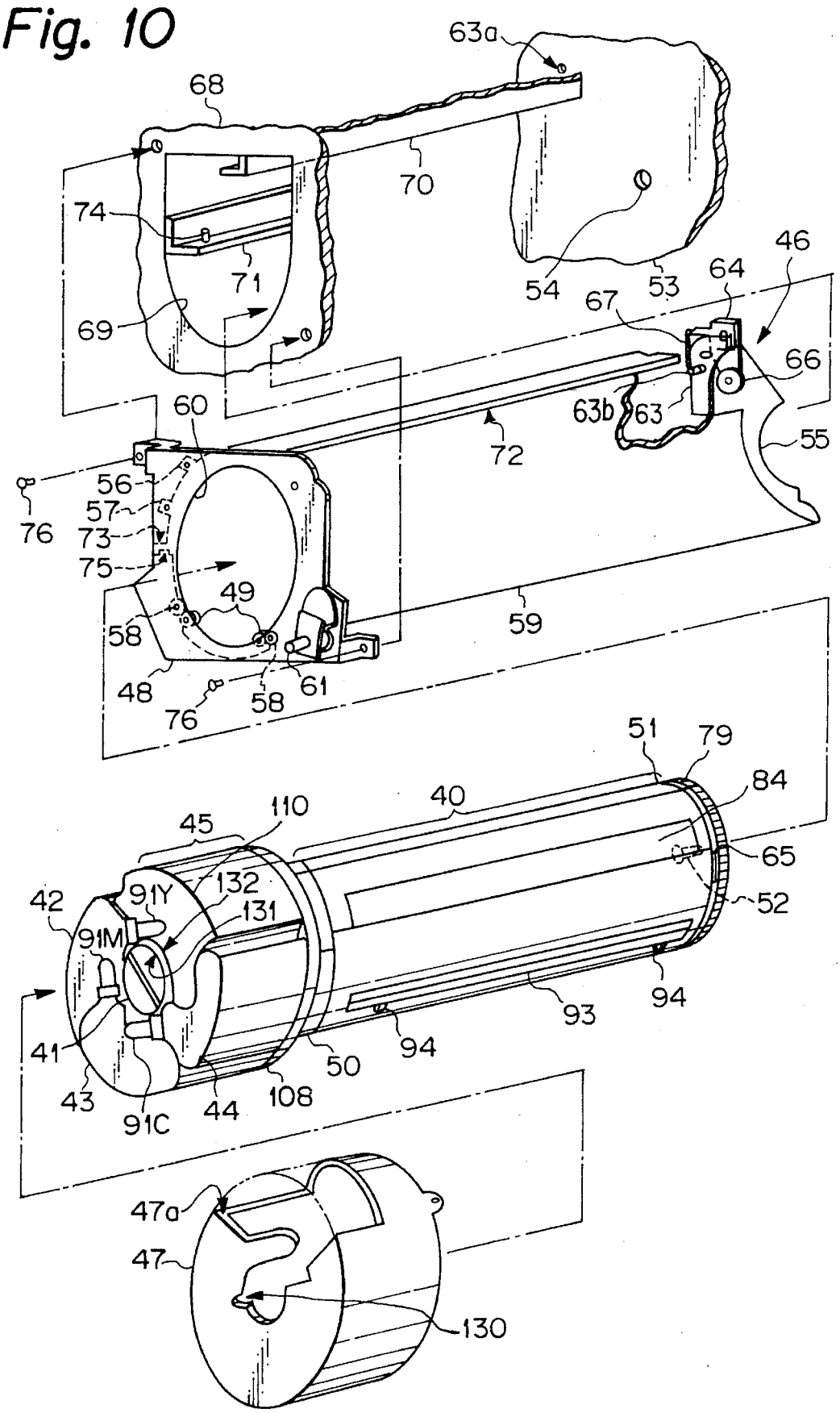
FIG. 10 is an exploded perspective view of an alternative embodiment of the present invention.
Figure 11:
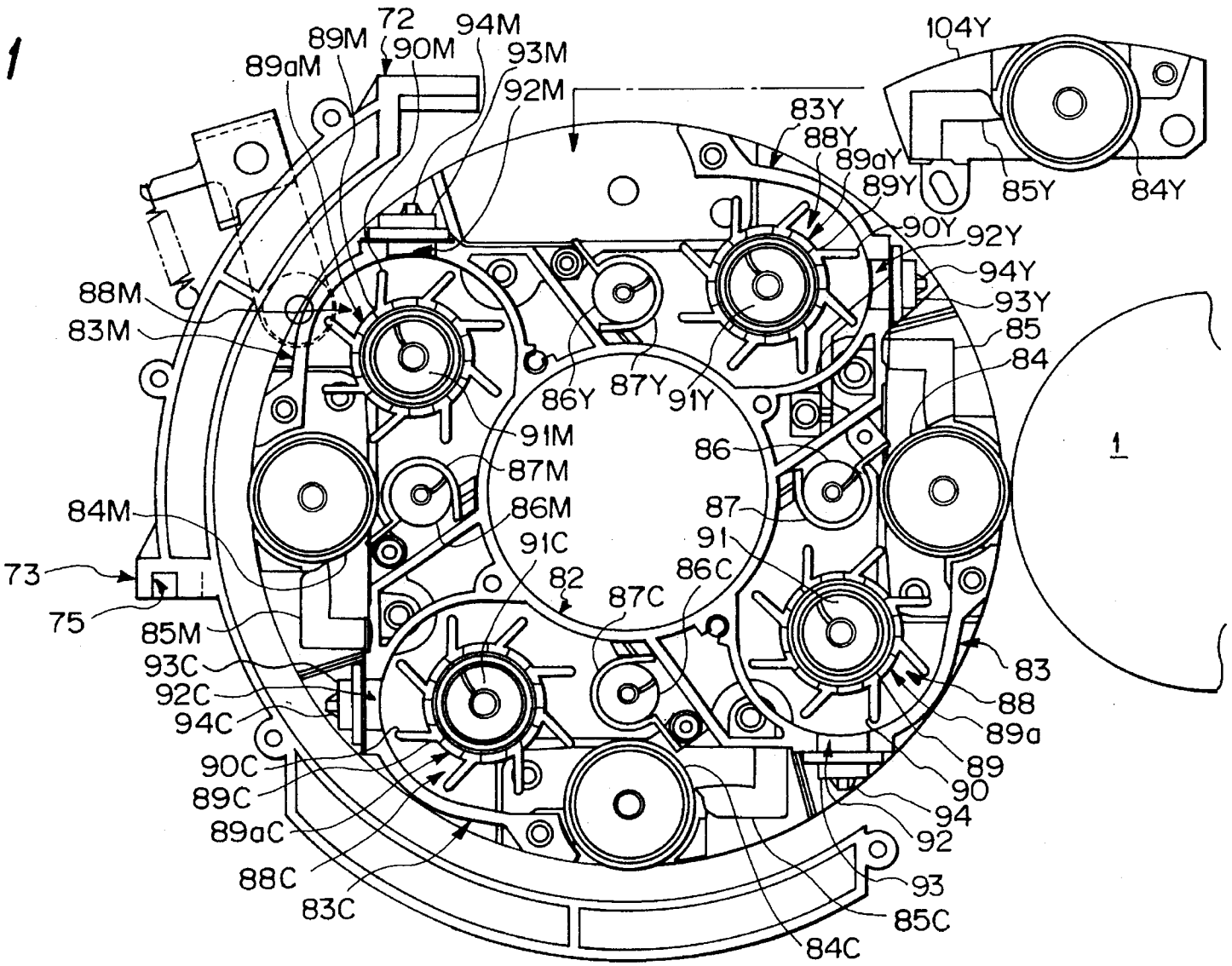
FIG. 11 is a section of developing sections included in the embodiment of FIG. 10.
Figure 12:
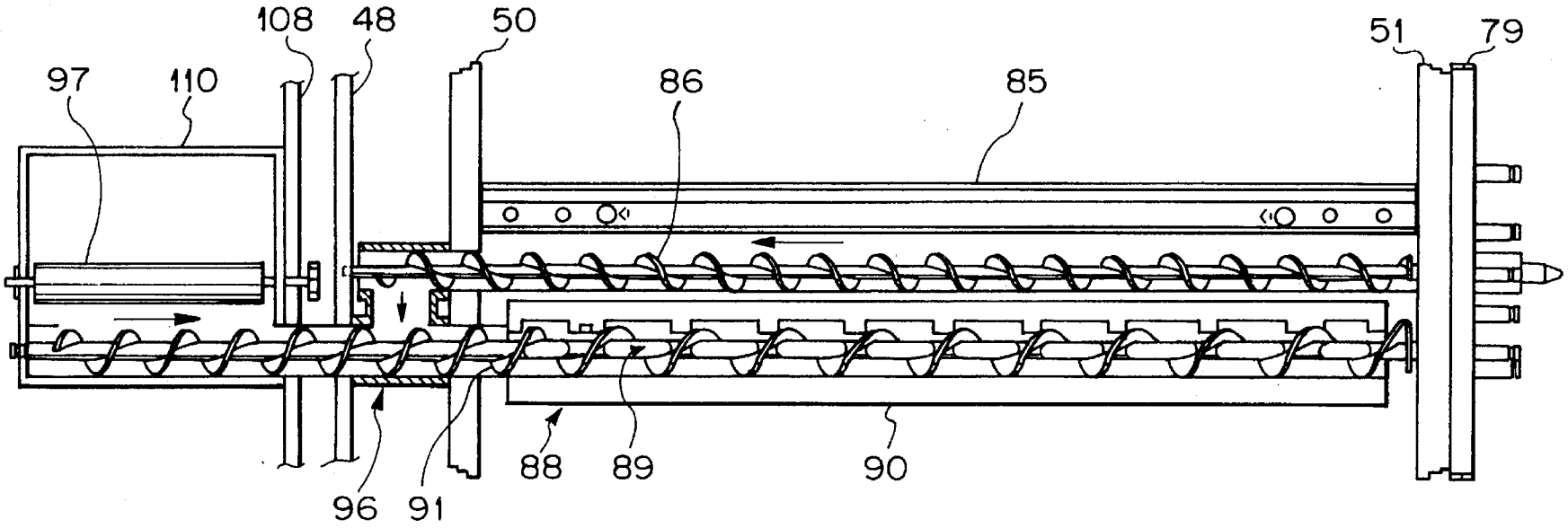
FIG. 12 shows a structure for communicating a toner container to a developing section and included in the embodiment FIG. 10.
Figure 13:
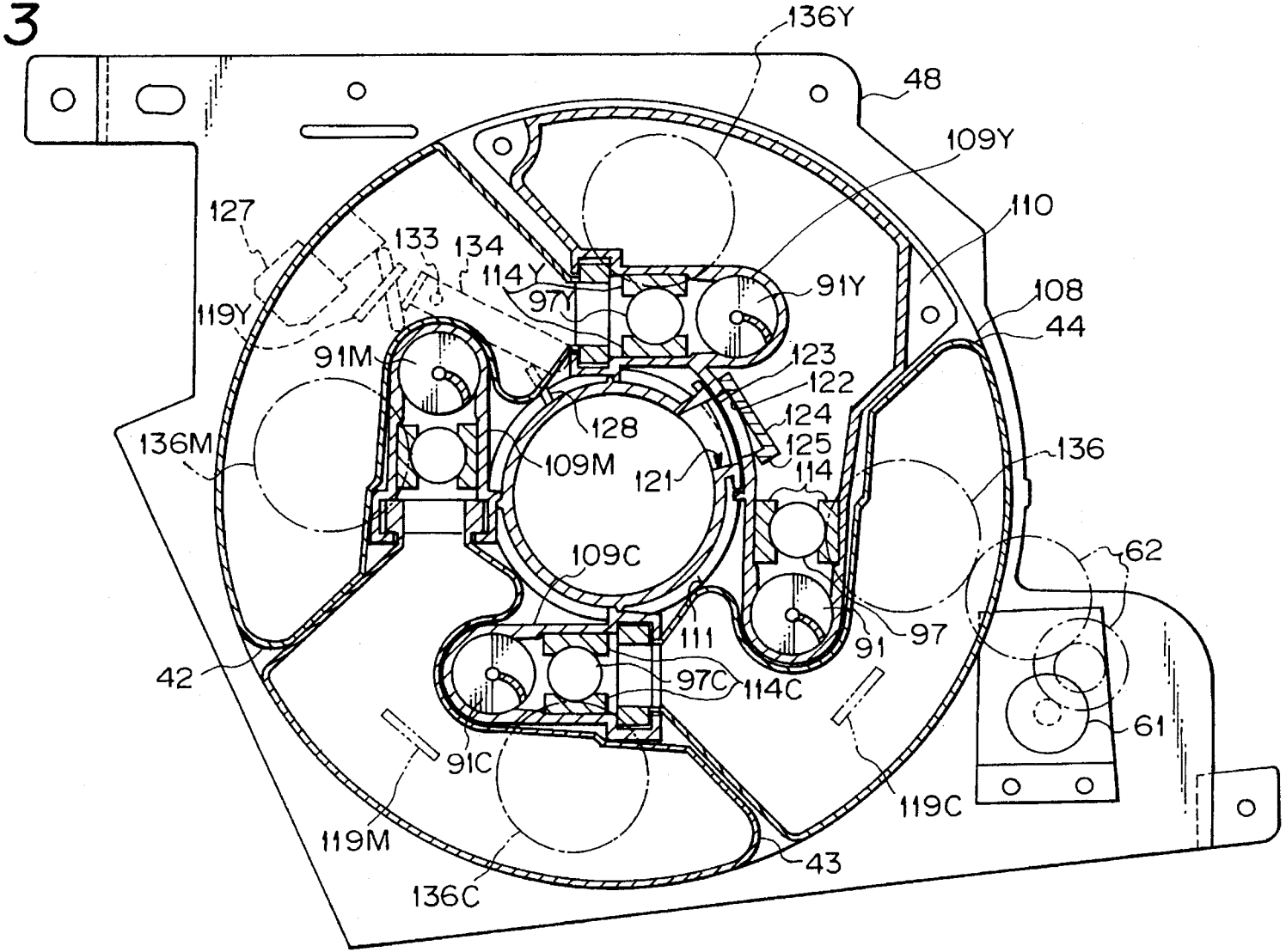
FIG. 13 is a section of toner storing sections included in the embodiment of FIG. 10.

FIG. 10 shows a third embodiment of the revolver in accordance with the present invention. FIG. 11 shows developing sections included in the revolver in a section. FIG. 12 is a vertical section in a plane containing screws 86 and 91 included in a black developing section. FIG. 13 is a section of a toner storing unit also included in the revolver.

As shown in FIG. 10, the revolver includes a developing unit 40 rotatable about its own axis in a printer body and having, for example, a black developing unit, cyan developing unit, yellow developing unit, and magenta developing unit therein. A toner storing unit 45 is loaded with four toner containers 41, 42, 43 and 44 storing black toner, yellow toner, magenta toner, and cyan toner, respectively. The toner storing unit 45 is substantially concentric with and rotatable integrally with the developing unit 40 at the front of the developing unit 40. The developing unit 40 and toner storing unit 45, constituting the revolver, are received in and supported by a casing 46. The casing 46 is mounted to the printer body and slidable relative to the printer body substantially in parallel to the above-mentioned axis. A cover 47 covers the storing unit 45 and is not rotatable relative to the unit 45.

The casing 46 has a front support wall 48 on which two rollers 49, for example, are mounted. The developing unit 40 has a disk-like front wall 50 supported by the rollers 49. A tapered shaft 52 protrudes from the center of a disk-like rear end wall 51 included in the developing unit 40. The shaft 52 is rotatably supported by a hole 54 formed in a rear side wall 53 which forms part of the printer body. In this condition, the revolver is rotatable in the printer body and positioned such that the axis thereof is parallel to the axis of the drum 1 in substantially the same plane, as shown in FIG. 1 by way of example.

The casing 46 has a side cover 59 affixed to the front support wall 48 and a rear support wall 55 at opposite ends thereof and reinforced by tie bars 56 and 58. The front support wall 48 is formed with an opening 60 for the insertion of the revolver. Also mounted on the front support wall 48 are a motor 61 and a gear train 62 to be driven by the motor 61. The motor 61 drives via the gear train 62 a toner supply roller, which will be described, included in the toner storing unit 45. A plate 63 is affixed to the tie bars 56 and 57 within the casing 46 and in the vicinity of the rear support wall 55. A positioning pin 63b is studded on the plate 63 and mates with a positioning hole 63a formed in the rear side wall 53. A bracket 64 supports a positioning roller 66 and is rotatably mounted on the pin 63b between the plate 63 and the rear support wall 55. The bracket 64 is constantly biased by a spring 67.

A front side wall 68, also included in the printer body, is formed with an opening 69 for the insertion of the casing 46 carrying the revolver therewith. An upper guide 70 and a lower guide 71 extend between the opposite side walls 53 and 68 of the printer body in order to allow the casing 46 to slide thereon. The casing 46 has portions 72 and 73 to be guided by the guides 70 and 71, respectively. These portions 72 and 73 are respectively provided on the top and the side of the side cover 59. A groove 75 is formed in the underside of the portion 73 in order to receive an upright guide pin 74 studded on the guide 71.

A revolver output gear 78 is mounted on the rear side wall 53 of the printer body and driven by a motor (not shown) for driving the revolver. The motor 77 may be implemented by a stepping motor. A revolver input gear 79 is fastened to the rear of the rear end wall 51 of the developing unit 40 and provided with substantially the same diameter as the wall 51. Also mounted on the wall 53 of the printer body is an output gear (not shown) which is driven by a motor (not shown) for development. The gear (not shown) is used to drive a developing roller and other constituents of the developing unit 40.

The developing unit 40 has, in addition to the front and rear walls, partition walls intervening between the front and rear walls. Specifically, as shown in FIG. 11, the partition walls consist of a hollow cylindrical portion 82 for receiving a cylindrical black toner bottle, and four casing portions 83, 83C, 83M and 83Y. The casing portions 83-83Y extend radially from the cylindrical portion 82 and partition the space around it into four developing chambers having substantially an identical shape. The chambers each stores a mixture of carrier and toner of particular color, i.e., a two-component type developer. In the condition shown in FIG. 11, the chamber storing the black toner and carrier is shown as facing the drum 1 at the developing position. The chambers storing the yellow toner and carrier, magenta toner and carrier, and cyan toner and carrier, respectively, are sequentially arranged in this order in the clockwise direction, as viewed in the figure.

The following description will concentrate on the black developing chamber located at the developing position. The other developing chambers are distinguished from the black developing chamber and from each other by suffixes Y, M and C.

In the black developing chamber, the casing part 83 is formed with an opening facing the drum 1. A developing roller 84 is positioned in the chamber and partly exposed to the outside through the opening. Also disposed in the chamber are a doctor blade 85, an upper screw 86, a guide 87 for the screw 86, and a paddle 88. The doctor blade 85 regulates the amount of toner to be conveyed by the roller 84 to the developing position. The upper screw 86 conveys part of the developer removed by the doctor blade 85 from the rear to the front along the axis thereof. The paddle 88 agitates t h e developer existing in the chamber. Specifically, the paddle 88 has a hollow cylindrical portion 89 formed with a plurality of developer outlets 89*a* extending in the axial direction of the roller 84, and a plurality of blades 90 extending radially from the portion 89. A lower screw 91 is disposed in the portion 89 and conveys the developer along the axis thereof in the opposite direction to the screw 86. The casing portion is formed with an outlet 92 below the lower screw 91. The outlet 92 extends in the axial direction of the revolver and is selectively used to discharge a deteriorated developer or to replenish a fresh developer (with toner). A cap 93 is fitted on the casing portion by, for example, a screw 94 in order to close the outlet 92.

As shown in FIG. 12, the front ends of the two screws 86 and 91 are extended to the outside of the effective width of the developing roller 84 (to the outside of the end wall 50 of the developing unit 40 in the illustrative embodiment). A drop section 96 is formed around the extensions of the screws 86 and 91. In the drop section 96, the developer conveyed by the screw 86 is dropped onto the screw 91 by gravity. The front end of the lower screw 91 is further extended beyond the drop section 96 to a communication chamber below a toner supply roller 97 which is included in the toner storing unit 45, as will be described specifically later. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer into the effective width of the roller 84. As a result, the developer is discharged from the paddle 88 into the chamber via the outlets 89*a* and again deposited on the roller 84. In this manner, the developer is agitated in the chamber in the horizontal direction. The developer discharged to the lower portion of the chamber via the outlets 89*a* is agitated by the blades 90 of the paddle 88 in the vertical direction. At the same time, the toner supply roller 97 is rotated to drop a fresh toner onto the screw 91 in the communication chamber. The screw 91 conveys the fresh toner to the drop section 96. On reaching the drop section 96, the toner is mixed with the developer dropped from the screw 86. The resulting mixture enters the chamber via the outlets 89*a*, thereby increasing the toner concentration in the chamber.

An input gear for development, for example, is rotatably positioned in the vicinity of the rear end wall of the developing unit 40, specifically at the rear of the revolver input gear 79 affixed to the wall 51, although not shown in the figure. The input gear meshes with the output gear 81 for development mounted on the printer body. Gears are mounted on the ends of the developing roller 84 and screws 86 and 91 which extend throughout the rear end wall 51 as well as the others. This kind of gearing drives the rotary bodies, including the roller 84, disposed in the chamber.

The front and rear end wall portions supporting the developing roller 84 and doctor blade 85 are each implemented as a small wall piece separable from the other front and rear wall portions. This is illustrated in FIG. 11, taking the yellow developing section as an example (small wall piece 104Y). When the chamber should be cleaned or when the parts should be replaced, the wall piece 104Y, carrying the roller 84Y and doctor blade 85Y therewith, can be bodily removed to facilitate the access to the chamber.

As shown in FIG. 13, the toner storing unit 45 has a disk-like base plate 108 (see also FIG. 10). Four receptacles, or cases, 109Y, 109M, 109C and 1 10 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will each be positioned substantially just above the extension of the screw 91 when the corresponding chamber is brought to the developing position.

The base plate 108 is formed with a circular through hole 111 at the center thereof. The hole 111 allows the cylindrical black toner container (see FIGS. 15A and 15B) to be passed therethrough. The receptacles 109Y–110 are so positioned as not to interfere with the hole 111. Further, the base plate 108 is formed with holes assigned to the lower screws 91 extending out from the developing chambers, and holes assigned to trough-like screw covers 112 (see FIG. 14) which are optional parts. The screws 91 each extend into one of the receptacles 109Y–110 via the base plate 108.

The shafts of the toner supply rollers 97Y–97 are journalled to the base plate 108. Gears are mounted on the ends of the shafts extended toward the developing unit 40 throughout the base plate 108. As shown in FIG. 13, these gears are respectively held in mesh with input gears 136 mounted on the end of the base plate 108 facing the developing unit 40. As also shown in FIG. 13, when one chamber is brought to the developing position, one of the input gears 136 associated with the roller 97 of t h e receptacle matching the chamber is brought into mesh with the gear 62. The gear 62 is driven by the motor 61 mounted on the front support wall 48. The motor 61 is controllably driven to cause the fresh toner to be replenished in a controlled amount.

Figure 14:
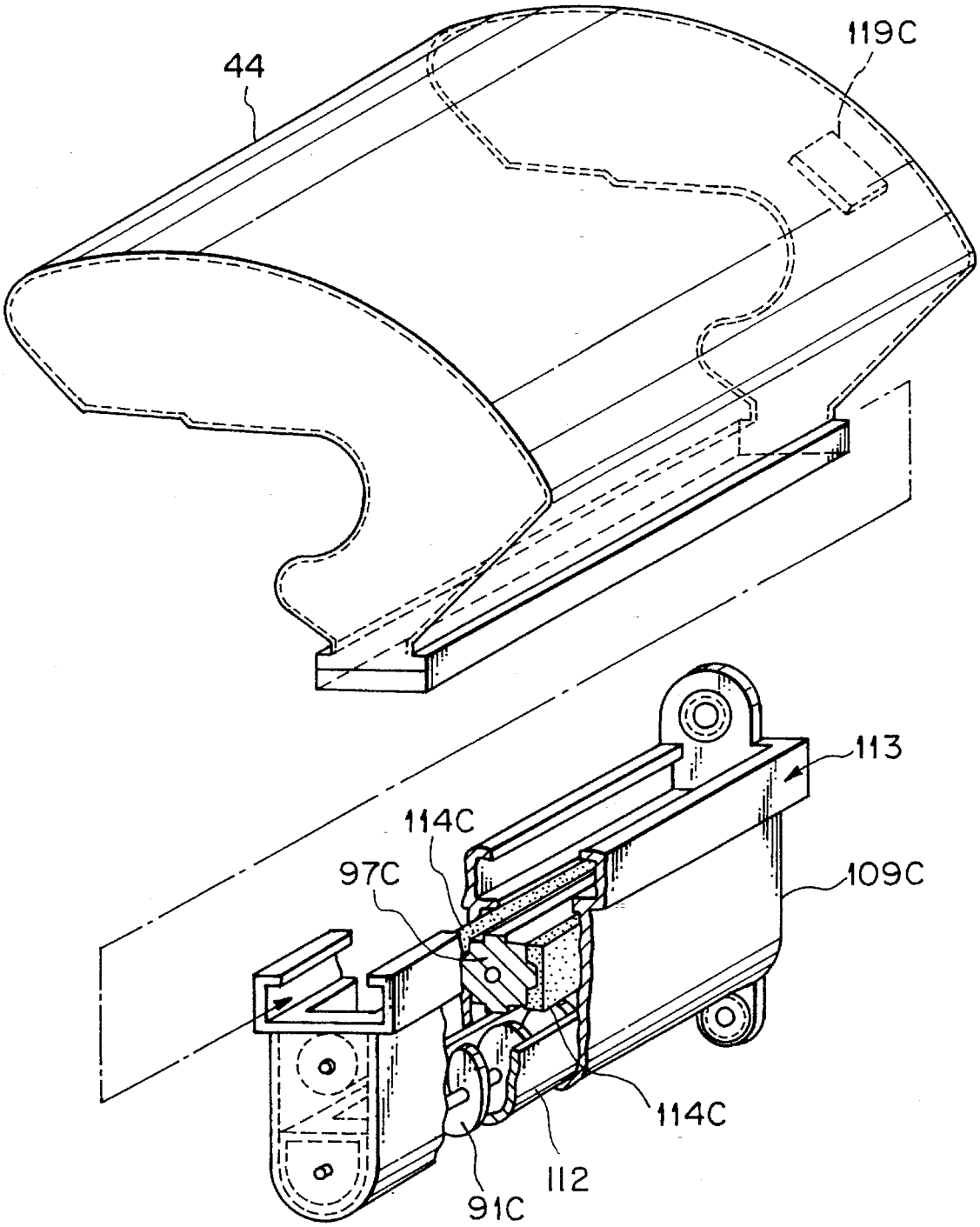
FIG. 14 is a perspective view of a color toner container and a portion for mounting the it and included in the embodiment of FIG. 10.

FIG. 14 shows the receptacle 109C assigned to the cyan toner, and the cyan toner container 44. The receptacles 109Y, 109M and 109C have an identical configuration. The receptacle 109C, for example, has a wall surrounding the portion of the lower screw 91 present in the receptacle 109C. The wall is formed with a toner inlet at such a position that the inlet overlies the toner supply roller 97C when the associated chamber is located at the developing position. The inlet is surrounded by a mount portion 113. The cyan toner container 44 is mounted to the mount portion 113 with the outlet thereof facing downward, by being slid in the axial direction of the revolver. Seal members 114C are fitted on part of the inner periphery of the receptacle 109C which face the roller 97. The seal members 114C and roller 97C divide the interior of the mount portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate 50 and drop section 96. It is to be noted that the rollers 97Y–97 each includes a portion where a plurality of grooves extend in the axial direction.

Toner containers 42, 43 and 44 are each configured to engage with the wall, surrounding the lower screw 91, of one of the receptacles located upstream of the corresponding receptacle with respect to the direction of rotation of the revolver. Lugs 119Y, 119M and 119C are respectively formed on the outer surface of the rear end wall 51. A set sensor, not shown, senses the lugs 119Y–119C.

As shown in FIG. 13, the receptacle 110 assigned to the black chamber has a wall substantially identical with the contour of the color toner receptacle 109Y, 109M or 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in a portion thereof which faces the center line of the revolver. The toner inlet 122 is identical in shape with the toner outlet 121 of the container 41 shown in FIGS. 15A and 15B. Black toner received from the container 41 via the inlet 122 accumulates in the wall portion similar to the color toner container, and a portion surrounded by the roller 97 and adjoining part and corresponding to the hopper of a conventional toner replenishing device. The black toner is conveyed from such portions to the communication chamber by the roller 97. A shutter 124 is rotatably supported at one end by a shaft 123 parallel to the axis of the revolver. The inlet 122 can be closed by the shutter 124 at the inside of the receptacle 110. Specifically, the shutter 124 angularly moves about the shaft 123 due to its own weight while the revolver is in revolution, thereby automatically opening and closing the inlet 122. A seal member 125 is fitted on the edge of the shutter 124.

Figure 15A:
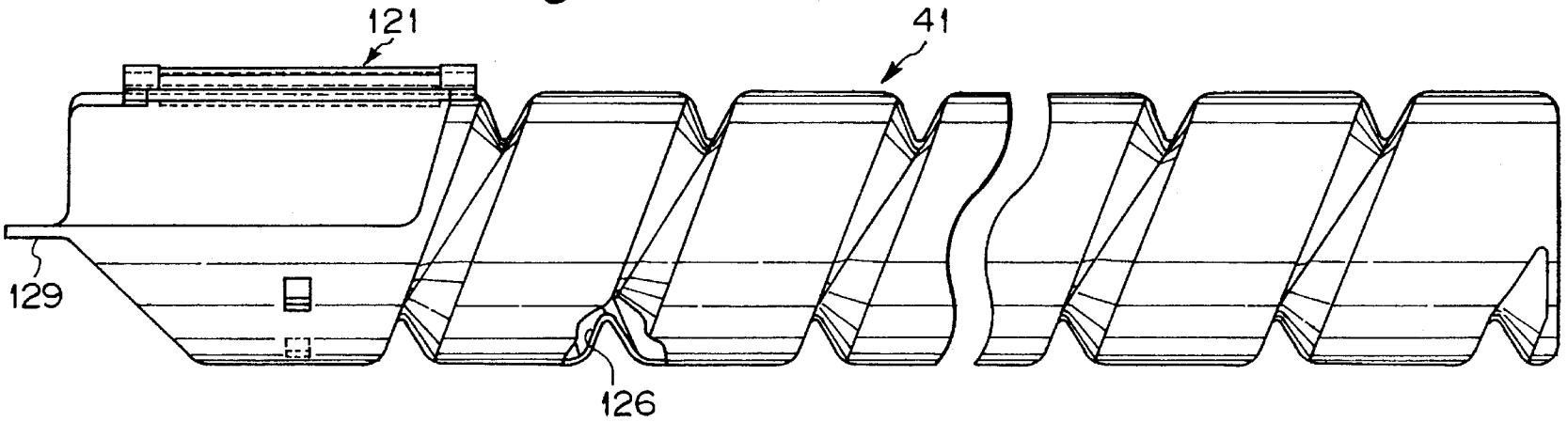
FIG. 15A is a side elevation of a black toner container included in the embodiment of FIG. 10.
Figure 15B:
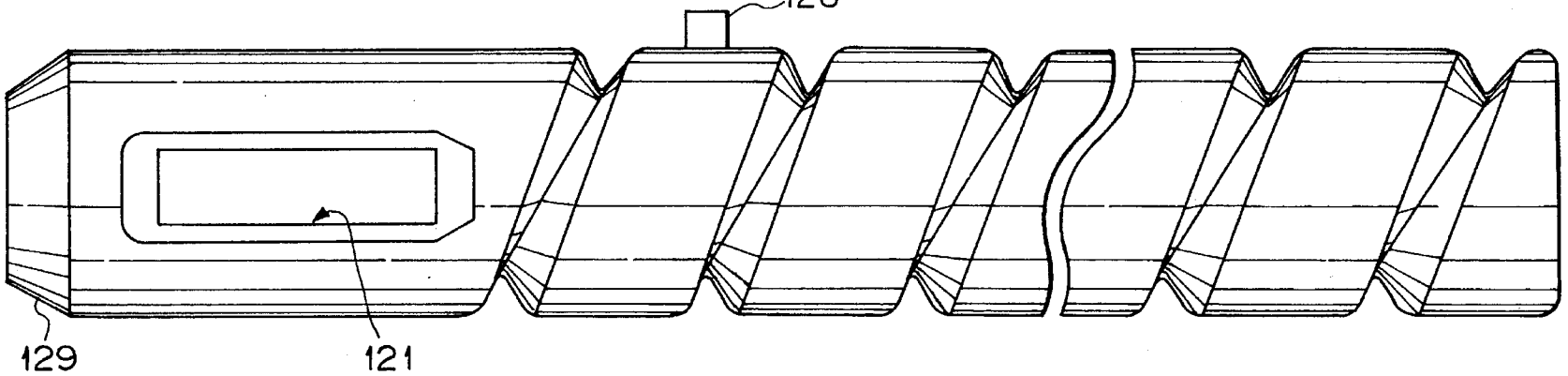
FIG. 15B is a front view of the black toner container.

As shown in FIGS. 15A and 15B, the container 41 has the outlet 121 formed in the circumferential wall of one end portion thereof. A spiral ridge 126 is formed in the inner periphery of the container 41 from the end remote from the outlet 121 toward the outlet 121. When the container 41 is mounted to the revolver, the spiral ridge 126 rotates integrally with the revolver so as to feed the toner from the rear end toward the outlet 121. A lug 128 is provided on the outer periphery of the container 41 at the rear of the outlet 121. A grip portion 129 is provided on the front end of the container 41. A set sensor 127 is mounted on the revolver, i.e., the rear of the front support wall 48 of the casing 46. A link 134 is rotatably mounted on the rear of the support wall 48 by a shaft 133. The lug 128 is sensed by the set sensor 127 via the link 134.

Figure 16A:
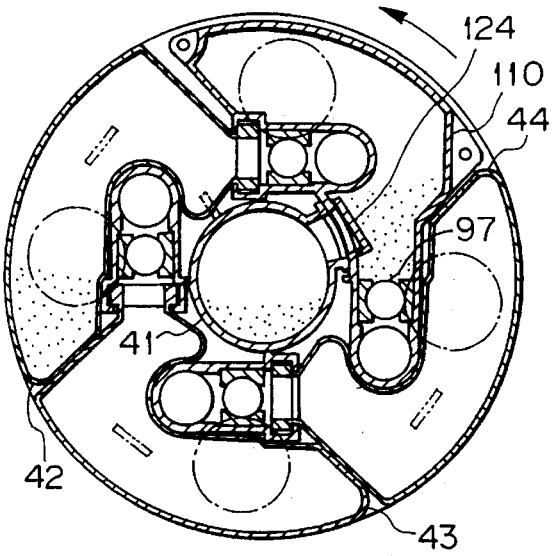
FIGS. 16A–16D demonstrate how toner moves in each toner container when the embodiment of FIG. 10 revolves.

FIGS. 16A–16D demonstrate how the toner in each of the toner containers 41–44 and black toner receptacle 110 moves when the revolver revolves in a direction indicated by an arrow. Because the color toner containers 42–44 are identical in respect of the movement of the toner, only the toner in the yellow toner container 42 is shown. As for the black toner, when the black chamber is located at the developing position, the toner in the receptacle 110 moves downward due to its own weight while being guided by the wall of the receptacle 110, as shown in FIG. 16A. The black toner accumulates in the lower portion of the receptacle 110 above the toner supply roller 97 and corresponding to a conventional hopper. Hence, the black toner is ready to be fed to the communication chamber where the lower screw 91 is present. At this instant, the outlet 121 of the black toner container 41 faces upward, preventing the black toner from being fed into the receptacle 110. Also, the shutter 124 prevents the black toner from flowing from the receptacle 110 into the container 41.

Figure 16B:
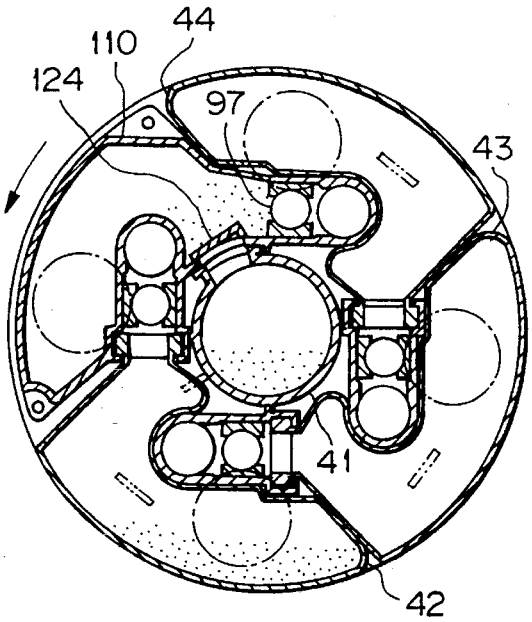
Figure 16C:
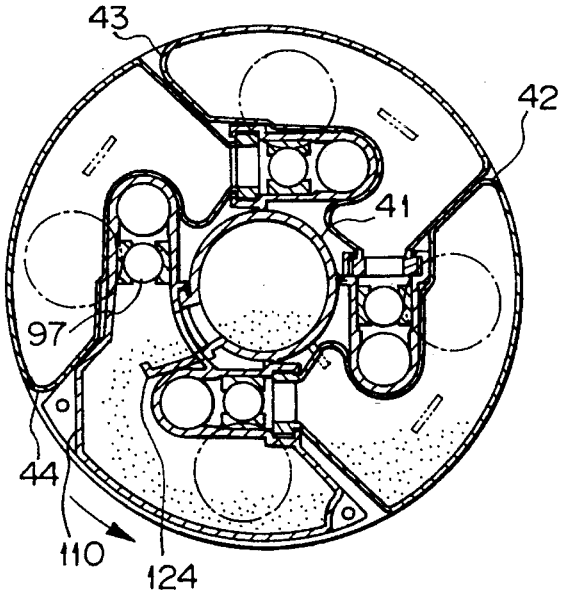
Figure 16D:
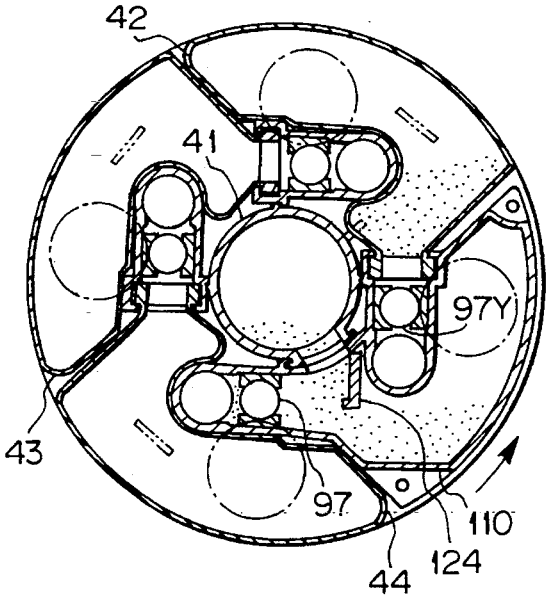

As shown in FIG. 16B, when the revolver rotates 90 degrees to bring the cyan developing chamber to the developing position, the black toner sequentially moves from the position adjoining the roller 97 toward the inlet 122 located below and at the left of such a position. As shown in FIG. 16C, when the revolver further rotates 90 degrees until the magenta developing chamber reaches the developing position, the shutter 124 opens by rotating about the shaft 123 due to its own weight. At the same time, the black toner adjoining the outlet 121, FIGS. 15A and 15B, starts moving into the receptacle 110 due to its own weight. When the revolver further rotates 90 degrees until the yellow developing unit arrives at the developing position, the black toner is further transferred to the receptacle 110, i.e., most of the toner around the outlet 12 1 is transferred to the receptacle 110. At this instant, the toner in the yellow toner container 42 moves onto the toner supply roller 97Y due to its own weight while being guided by the wall of the container 42. In this condition, the yellow toner is ready to be supplied to the associated communication chamber where the lower screw 91Y is present. In this manner, while the outlet 121 of the container 41 is positioned above the inlet 122 (FIGS. 16A and 16B), the inlet 122 is opened to receive the toner. However, when the inlet 122 is positioned above the outlet 121 (FIGS. 16C and 16D), the inlet 122 is closed to prevent the toner from being returned to the container 41.

When the color toner containers 42–44 are rotated integrally with the developing unit 40, the toner in each container is guided to the toner outlet by the inner periphery of the container and then dropped onto the associated toner supply roller 91Y, 91M or 91C via the outlet, as in the previous embodiment. This eliminates the need for a toner conveying member otherwise built in the toner container.

Figure 17A:
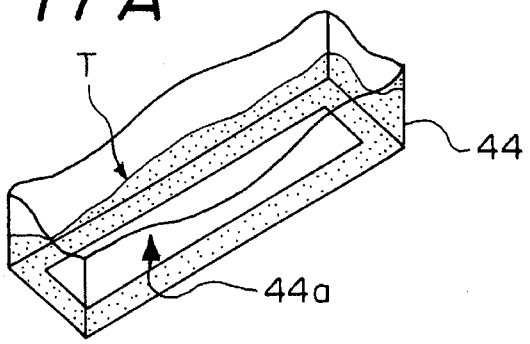
FIG. 17A shows toner remaining in the vicinity of the toner outlet of the container.

Again, if the shape of the portion of each container 42, 43 or 44 surrounding the outlet is apt to cause the toner not entering the outlet to accumulate, the toner is likely to remain there to the end. FIG. 17A illustrates this occurrence, taking the cyan toner container 44 as an example. As shown, when the outlet 44*a* is formed such that edges are left around the outlet 44*a*, the toner failed to enter the outlet 44*a* accumulates on the inner surfaces of the edges. The edges around the outlet 44*a* are intended to, for example, strictly prevent the toner from flying about. Specifically, a seal member may be adhered to the outer surfaces of the edges to prevent the toner from leaking from between the container and the mount portion 113, FIG. 13, of the receptacle.

Figure 17B:
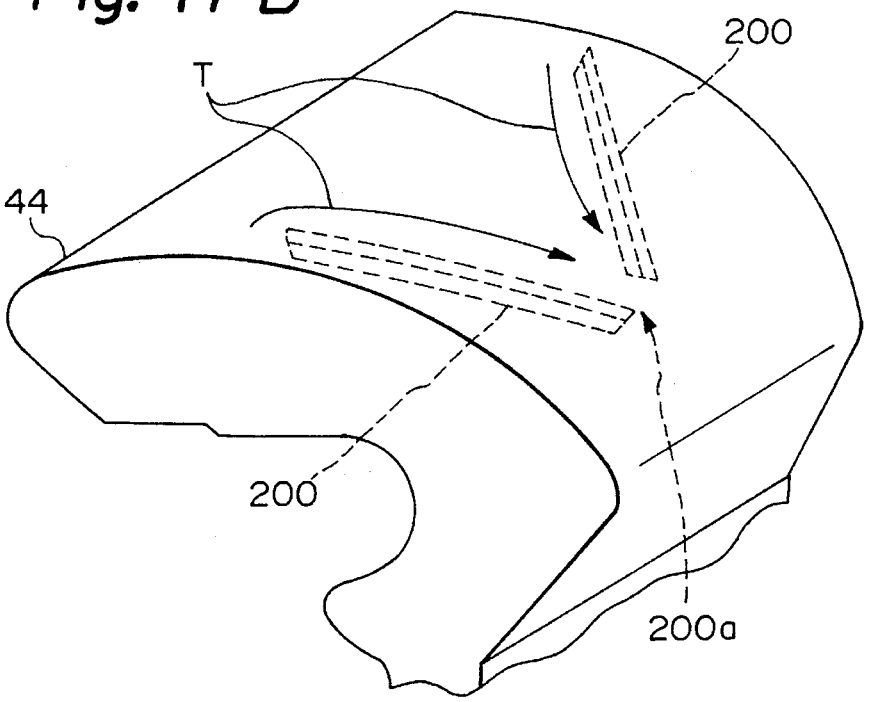
FIG. 17B is a perspective view of a specific configuration of a color toner container.

In light of the above, as shown in FIG. 17B, a pair of flat guide members 200 are provided on the circumferential wall of each of the color toner containers 42–44 (44 in the figure). The distance between the guide members 200 sequentially decreases from the upstream side to the downstream side in the direction in which the toner moves during the revolution of the developing unit 40. The downstream end 200*a* of the guide pair 200 is positioned such that the toner T being guided by the guide pair 200 is positioned substantially at the center of the width in the axial direction of the developing unit 40.

Figure 18A:
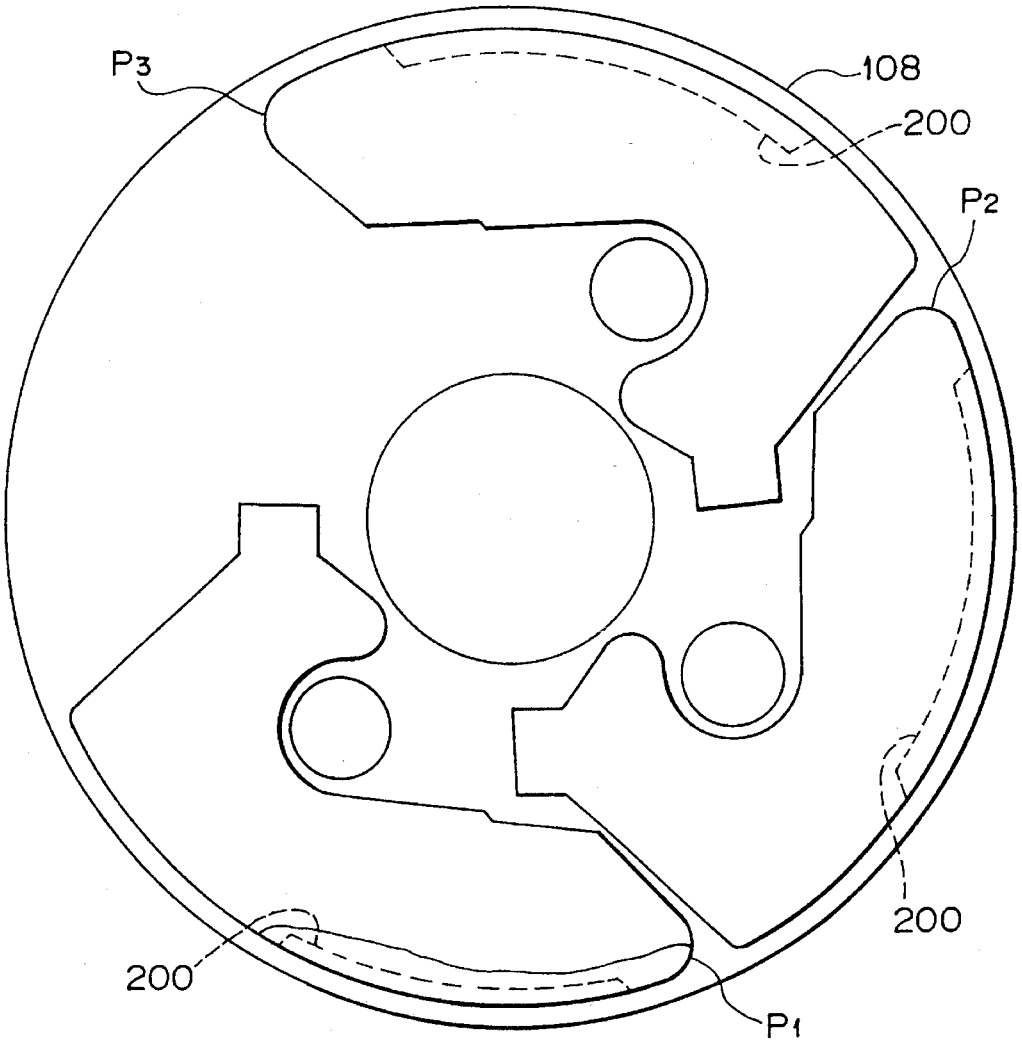
FIGS. 18A and 18B show how toner moves in the color toner container.
Figure 18B:
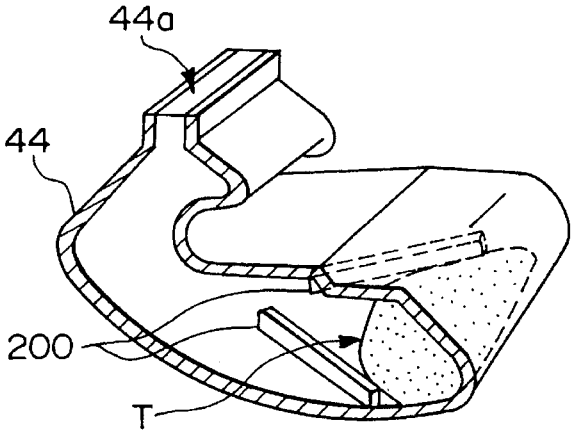

Assume that the amount of toner remaining in the toner container is small. For example, the toner T is present at the position P1 shown in FIG. 18A and in a range shown in FIG. 18B. Then, during the revolution of the developing unit 40, the toner T sequentially flows toward the outlet 44*a* along the guides 200 because the container moves from the position P1 to a position P3 via a position P2. As a result, even such toner T is successfully supplied to the toner supply roller.

Figure 17C:
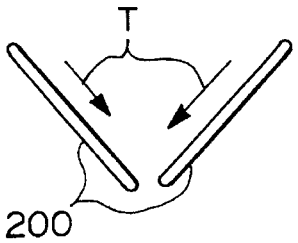
FIGS. 17C and 17D each shows a modification of the color toner container.
Figure 17D:
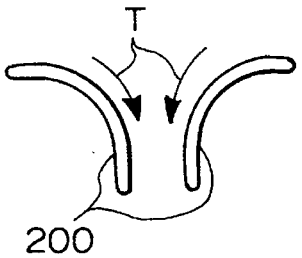
Figure 19:
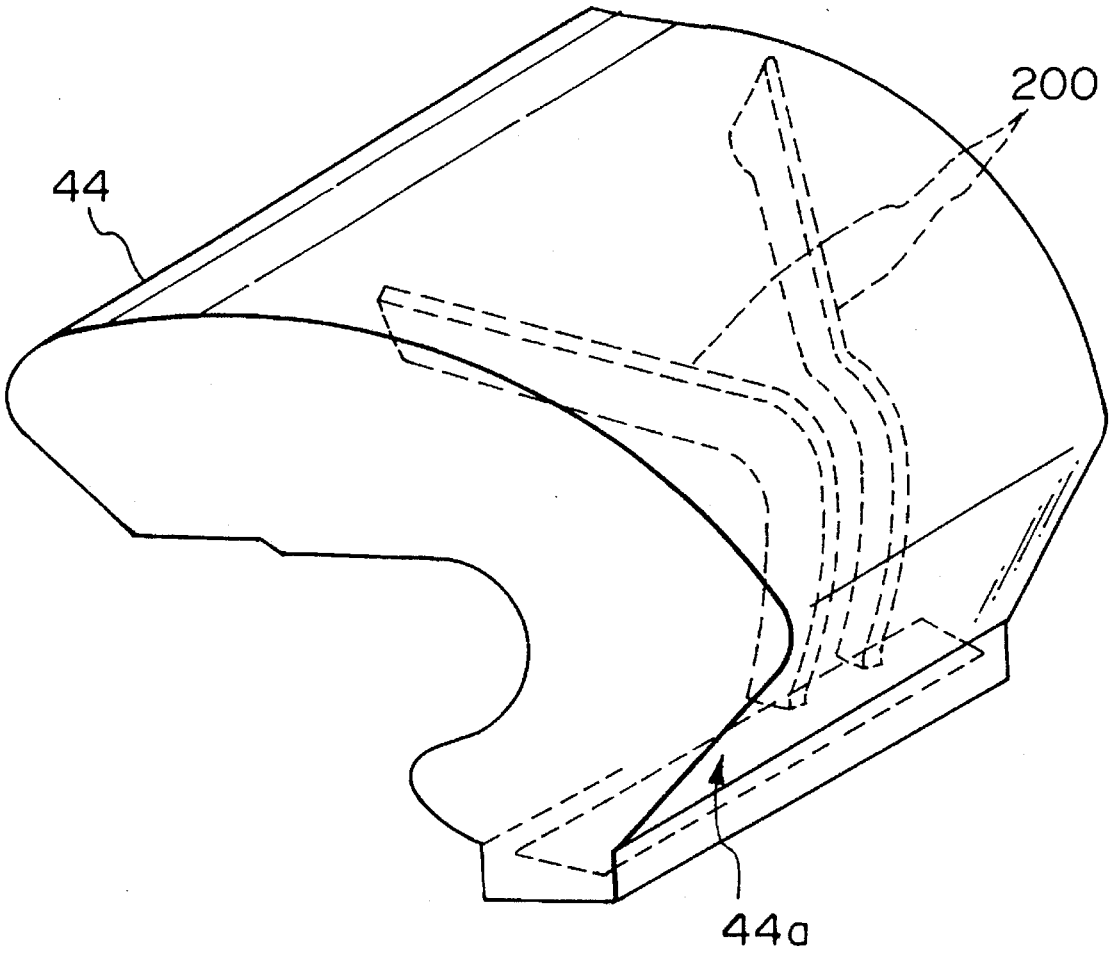
FIG. 19 shows another specific configuration of the color toner container.

FIGS. 17C, 17D and 19 each show a particular configuration of the guide members 200. The crux is that the guides 200 be capable of guiding the toner from opposite end portions in the axial direction to the outlet 44*a*, while urging it toward the center. Particularly, when the ends of the guide members 200 are extended to the vicinity of the outlet 44*a*, as shown in FIG. 19, the toner will be more surely guided to the outlet 44*a*.

4th Embodiment

Figure 20:
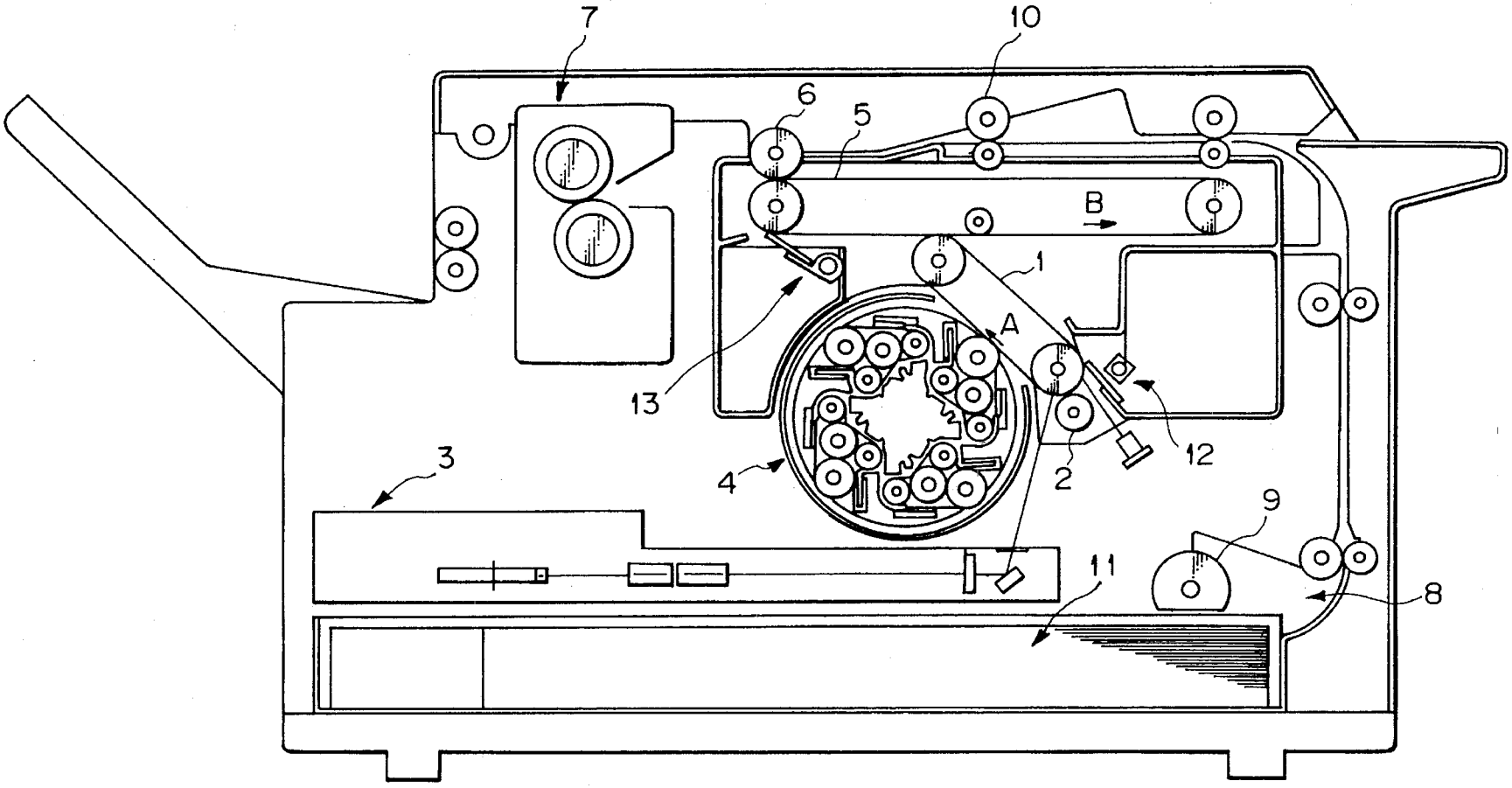
FIG. 20 is a section of a color printer representative of another alternative embodiment of the present invention.

A fourth embodiment to be described is applied to a full-color printer having a rotary developing device. As shown in FIG. 20, the printer includes an image carrier implemented as a photoconductive belt 1. The belt 1 is uniformly charged by a charge roller 2 and then scanned by laser optics 3 on the basis of image data. As a result, a latent image is electrostatically formed on the belt 1. The image data are each representative of one of monocolor images produced by separating a desired full-color image into yellow, magenta, cyan and black image components. The latent images sequentially formed on the belt 1 are respectively developed by yellow toner, magenta toner, cyan toner, and black toner stored in a revolver 4 which will be described. Consequently, toner images corresponding to the latent images are formed on the belt 1.

The belt 1 is rotated in a direction indicated by a n arrow A in FIG. 20. An intermediate image transfer belt 5 is rotated in a direction indicated by an arrow B in synchronism with the belt I. The yellow, magenta, cyan and black toner images are sequentially transferred from the belt 1 to the intermediate belt 5 in accurate register with each other. A transfer roller 6 is located at an image transfer position. When a paper 11 is fed from a cassette 8 to the image transfer position by a pick-up roller 9 and a registration roller 10, the transfer roller 6 transfers the composite toner image from the belt 5 to the paper 11. The composite toner image on the paper 11 is fixed by a fixing unit 7, turning out a full-color image.

The toner remaining on the belt 1 after the image transfer is removed by a cleaner 12. Likewise, the toner remaining on the intermediate belt 5 is removed by a cleaner 13.

Figure 21:
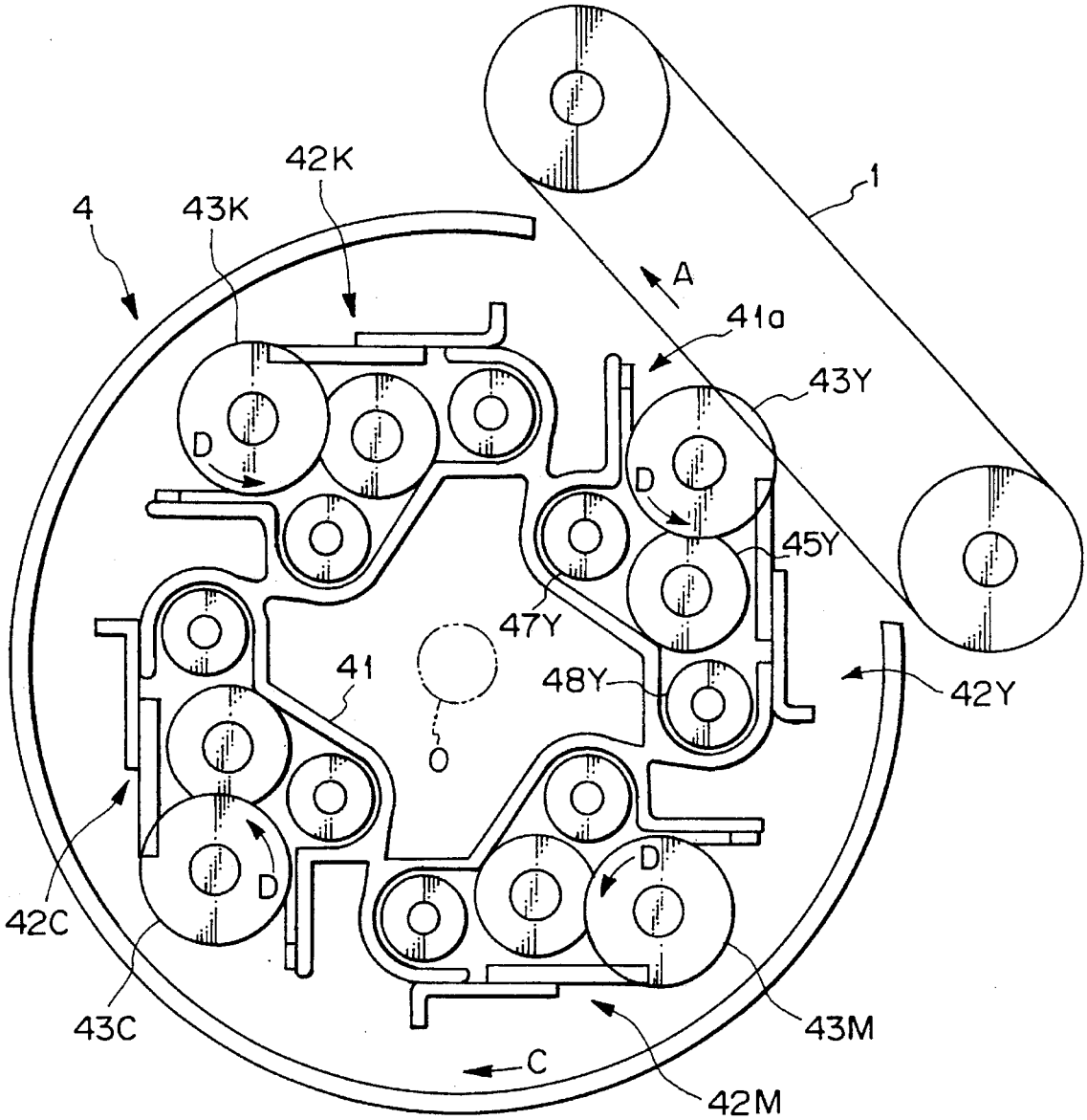
FIG. 21 is a section of a rotary developing device included in the embodiment of FIG. 20.

FIG. 21 shows the revolver 4 in a specific condition wherein one developing section, e.g., a yellow developing section, is located at a developing position. As shown, the revolver 4 is positioned in close proximity to the belt 1 and includes a casing, or rotary body, 41. The casing 41 is rotatable about a shaft 0 in a direction indicated by an arrow C in the figure. A drive mechanism, not shown, is drivably connected to the shaft 0. The casing 41 is so configured as to form a yellow developing section 42Y, a magenta developing section 42M, a cyan developing section 42C, and a black developing section 42K.

in the illustrative embodiment, the developing sections 42Y–42K respectively store nonmagnetic yellow toner, magenta toner, cyan toner, and black toner which are not accompanied by carrier. Developing rollers, or developer carriers, 43Y–43K are respectively disposed in the sections 42Y–42K, respectively. The rollers 43Y–43K are each partly exposed to the outside through a respective opening 41 a formed in the casing 41.

The revolver 4 is rotated about the shaft 0 to bring one of the sections 42Y–42K thereof to the developing position in accordance with the image data. The section 42 brought to the developing position causes the roller 43 thereof to rotate in a direction D, thereby developing a latent image formed on the belt 1. Toner images formed by the sections 42Y–42K by such a procedure are transferred to the paper 11 via the intermediate belt 5, as stated earlier.

The developing sections 42Y–42K have an identical configuration and operate in the same manner. Let the following description concentrate on the yellow developing unit 42Y by way of example. The same constituents of the developing units 42Y–42K are simply distinguished by the suffix.

Figure 22:
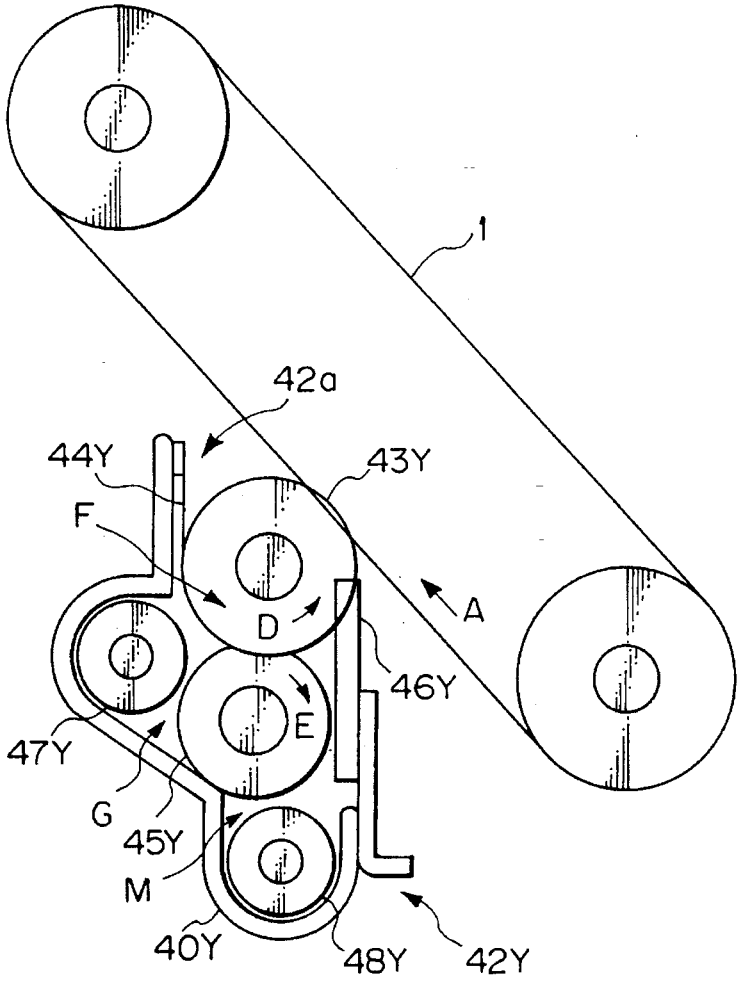
FIG. 22 is a section of a yellow developing section included in the device of FIG. 21.

As shown in FIG. 22, the developing unit 42Y is positioned below the belt 1 during development and supplies the yellow toner to a latent image formed on the belt 1. The section 42Y has a casing 40Y which is formed with an opening 42*a* in an upper portion thereof, as seen at the developing position. The developing roller 43Y is positioned in the opening 42*a* to face the drum 1. The roller 43Y is rotatable with a predetermined peripheral speed ratio to the belt 1 and movable in the same direction as the belt 1, as seen at the developing position. A screen member 44Y is held in contact with part of the roller 43Y downstream of the position where the roller 43Y faces the belt 1, and prevents the toner from leaking or flying about.

A supply roller, or toner supply member, 45Y is made of foam polyurethane or a similar elastic material and held in contact with the developing roller 43Y below the roller 43Y. The roller 45Y is rotatable with a predetermined peripheral speed ratio to the roller 43Y and movable in the same direction, E, as the roller 43Y, as seen at a position F where the rollers 45Y and 43Y contact. A blade 46Y is made or urethane rubber or a similar elastic material and located in the vicinity of the opening 42*a* and downstream of the roller 45Y with respect to the direction of rotation of the roller 43Y. The free end of the blade 46Y is held in contact with the roller 43Y.

A first toner conveying member in the form of a screw 47Y is located at the left of the position F in order to convey the toner from the front to the rear in a direction perpendicular to the sheet surface of FIG. 22. A second toner conveying member in the form of a screw 48Y is located below the supply roller 45Y and conveys the toner from the rear to the front in the above-mentioned direction. The screws 47Y and 48Y will be described in detail later.

Figure 23:
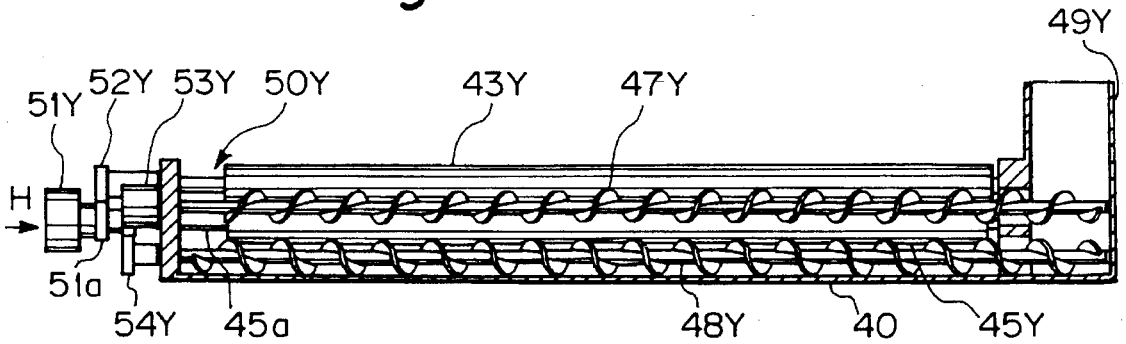
FIG. 23 is a section of the yellow developing section a s seen in the lengthwise direction thereof.
Figure 24:
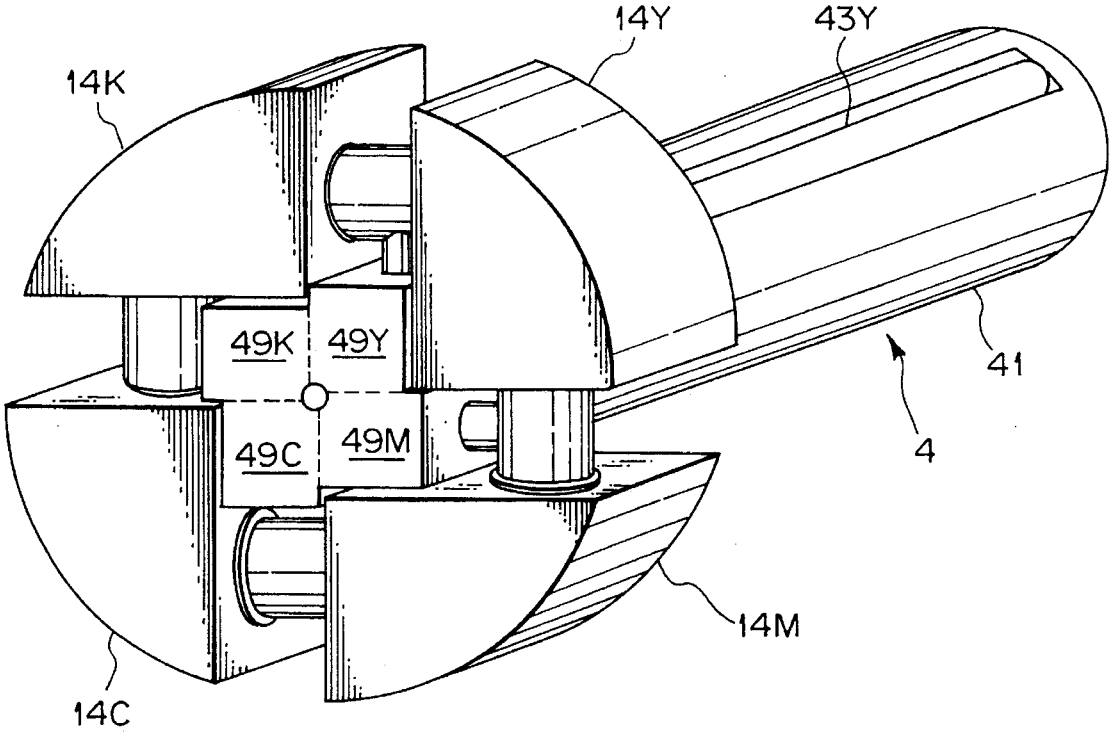
FIG. 24 is a perspective view of the device shown in FIG. 21.

As shown in FIG. 23 and 24, a hopper 49Y is positioned at one end of the developing unit 42Y. The first screw 47Y extends from the hopper 49Y to the other end of the developing section 42Y in parallel to the developing roller 43Y and supply roller 45Y. The screw 47Y is rotated in association with the rollers 43Y and 45Y and with a predetermined peripheral speed ratio thereto, conveying the toner from the hopper 49Y to the other end of the section 42Y. As shown in FIG. 22, the casing 40 is so configured as to partly contact the roller 45Y. The rollers 43Y and 45Y, screen member 44Y and casing 40 define a space G around the screw 47Y.

The toner conveyed from the hopper 49Y to the space G by the screw 47Y is fed to the roller 45Y. The roller 45Y supplies the toner to the roller 43Y while rubbing it between the rollers 45Y and 43Y at the position F. As a result, the toner is deposited on the roller 303Y by being electrostatically charged. While the roller 43Y conveys the toner, the blade 46Y levels the toner to form a thin toner layer having a predetermined thickness. The roller 43Y develops a latent image formed on the belt 1 with the thin toner layer by contact or non-contact development.

Part of the toner not used in the developing step is conveyed by the first screw 47Y to the other end of the developing section remote from the hopper 49Y. As shown in FIG. 23, a circulating portion 50Y is positioned at the end remote from the hopper 49Y and outside of the effective diameter portions of the rollers 43Y and 45Y in the axial direction. The toner conveyed to the circulating portion 50Y by the screw 47Y is dropped to the bottom of the section 42Y due to gravity.

The second screw 48Y is positioned in the lower portion of the section 42Y in parallel to the rollers 43Y and 45Y and first screw 47Y. The screw 48Y is rotated to return the toner not used in the developing step to the circulating portion 50Y. By adequately selecting the amounts of toner to be conveyed by the screws 47Y and 48Y, it is possible to supply the toner to the supply roller 45Y without sensing the amount of toner in the developing unit 42Y and without resorting to complicated control over the toner supply. In addition, this kind of configuration implements a miniature revolver having great freedom of layout and having a small sectional occupancy ratio relative to the belt 1.

As shown in FIG. 24, toner cartridges, or fresh toner containers, 14Y, 14M, 14C and 14K are respectively removably mounted to the hoppers 49Y–49K of the developing sections 42Y–42K. The cartridges 14Y–14K are mounted to the revolver 4 or replaced in the event that the revolver 4 is mounted to the apparatus for the first time or when the cartridges 14Y–14K run out of tone.

Figure 25:
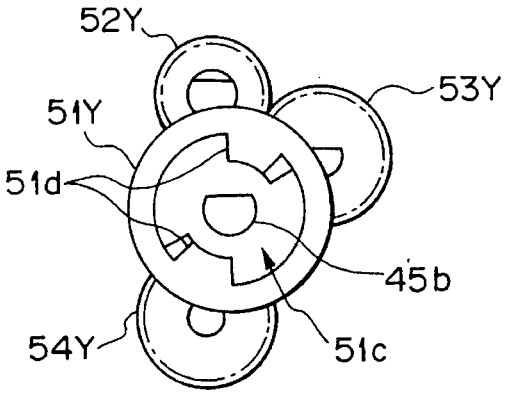
FIG. 25 is a view as seen in a direction H of FIG. 23.

A drive mechanism included in the embodiment will be described, taking the yellow developing section 42Y as an example. FIG. 25 is a front view as seen in a direction H shown in FIG. 23 and shows a drive section assigned to the developing section 42Y. As shown, a coupling gear 51 Y is mounted on the shaft 45*a* of the supply roller 45Y. A gear 51*a* and a gear 51*b* (not shown in FIG. 25) are provided on the coupling gear 51Y. A gear 52Y is provided on the developing roller 43Y. Further, gears 53Y and 54Y are respectively provided on the first and second screws 47Y and 48Y. The gear 51*a* is held in mesh with the gear 52Y while the gear 51*b* is held in mesh with the gears 53Y and 54Y. The coupling gear 51Y has a cavity 51*c* in which a pair of pawls 51*d* are positioned.

Figure 26A:
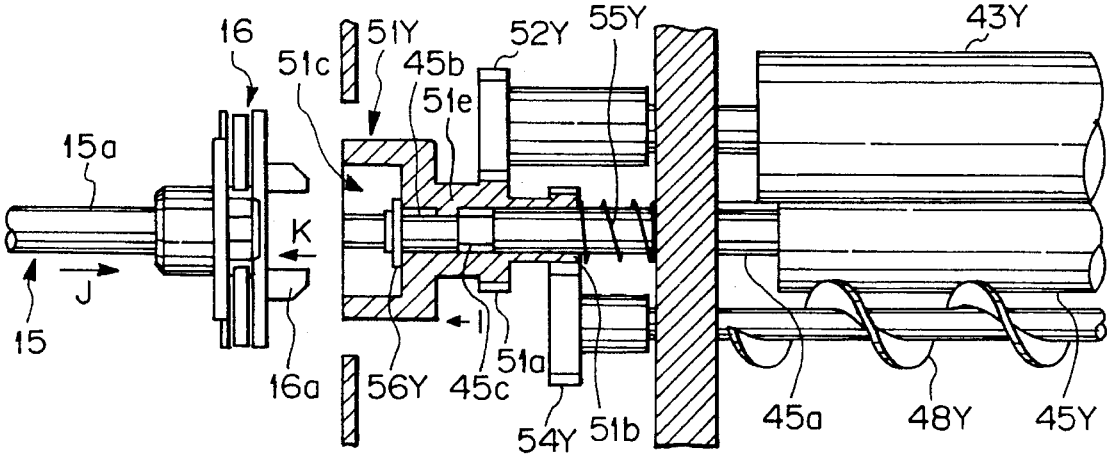
FIGS. 26A–26C demonstrate the operation of a drive mechanism assigned to the developing sections.
Figure 26B:
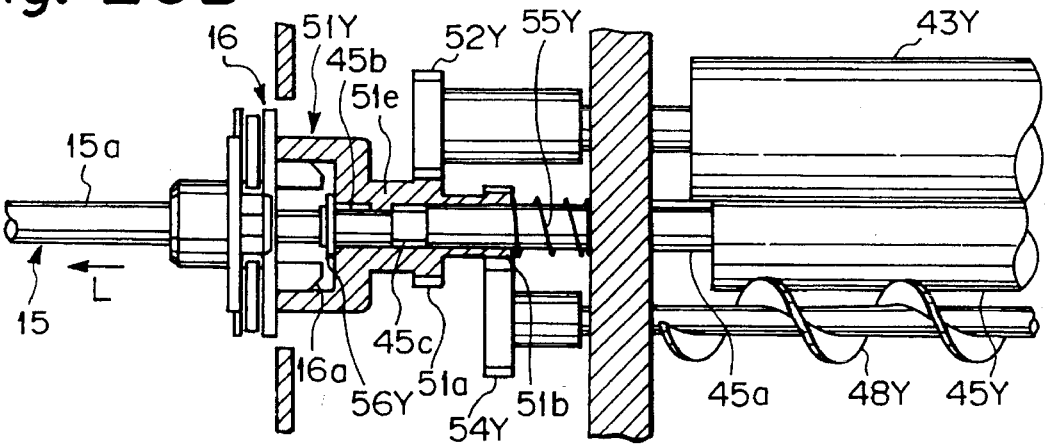
Figure 26C:
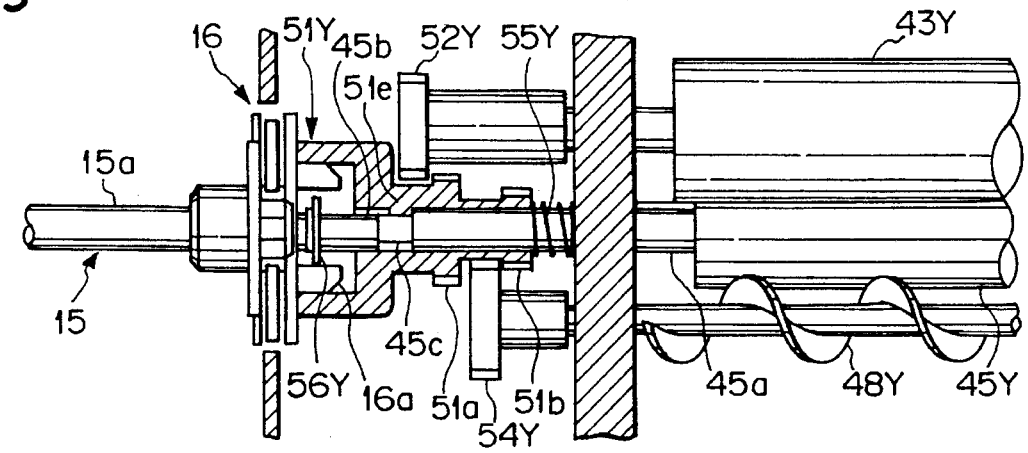

FIGS. 26A–26C are side elevations showing the drive section of the developing section 42Y. In these figures, the first screw 47Y and gear 53Y provided thereon are not shown. As shown in FIG. 26A, the coupling gear 51Y is constantly biased by a spring 55Y in a direction 1 and stopped by a stop ring 56Y. The shaft 45*a* of the supply roller 45Y includes a portion 45*b* having a D-shaped section, while the coupling ring 51Y includes a hollow portion 51*e* complementary in shape to the portion 45*b*. The portions 45*b* and 51*e* are usually coupled with each other, so that the coupling gear 51Y and supply roller 45Y rotate integrally with each other.

Figure 27:
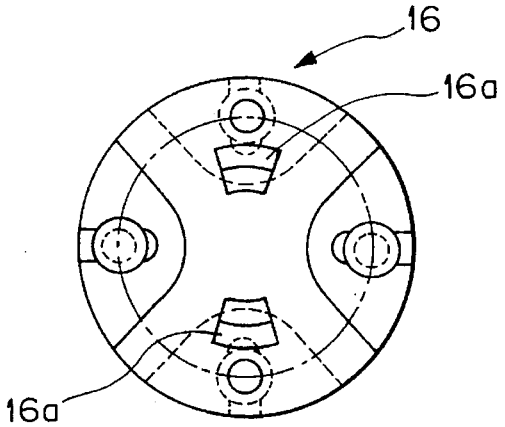
FIG. 27 shows a coupling as seen in a direction K of FIG. 26A.

As also shown in FIG. 26A, a joint 15 is mounted on the printer body to be slidable in the axial direction. When the supply roller 45Y and coupling gear 51Y are positioned at the developing section, the joint 15 is rotatable substantially coaxially with the roller 45Y and gear 51Y. The joint 15 transfers a driving force to the supply roller 45Y as well as to the other members when engaged with the coupling gear 51Y. A coupling 16 is mounted on the shaft 15*a* of the joint 15 at the end of the joint 15. A pair of lugs 16*a* are formed on the end of the coupling 16 and engageable with the pawls 51*d* of the coupling gear 51Y. The tips of the lugs 16*a* are tapered to be smoothly received in the cavity 51*c* of the gear 51Y. Because the joint 15 is caused to slide while rotating about its own axis, the lugs 16*a* and pawls 51*c* can surely mate with each other. FIG. 27 is a view of the coupling 16 as seen in a direction K shown in FIG. 26A.

In operation, when the developing section 42Y, for example, is brought to a stop at the developing position, the joint 15 is caused to slide in a direction J, FIG. 26A, by a solenoid or similar actuating mechanism while being rotated by a main motor via a gearing, not shown. As shown in FIG. 26B, when the joint 15 slides a predetermined distance, the lugs 16*a* of the coupling 16 are received in the cavity 51*c* of the coupling gear 51. As a result, the lugs 16*a* mate with the pawls (not shown) of the cavity 51*c* and rotate the supply roller 45Y in a predetermined direction at a predetermined speed. At the same time, the driving force is transferred to the developing roller 43Y and screws 47Y and 48Y via the previously mentioned gears 51*a* and 51*b*, 52Y, 53Y and 54Y.

When the section 42Y ends its operation at t h e developing position, the joint 15 is caused to slide in a direction L with the result that the lugs 16*a* of the coupling 16 are released from the cavity 51*c* and pawls 51*d* of the coupling gear 51Y. Subsequently, the revolver 4 is rotated to bring another developing unit to the developing position. When a predetermined sequence of developing steps are completed, the drive from the printer body is interrupted so as to deactivate all the developing units 42Y–42K.

In the printer with the above construction, the revolver 4 has a number of guaranteed printings. When the number of papers 11 undergone development reaches the number of guaranteed printings, the revolver 4 must be replaced. In light of this, the revolver 4 is removably mounted on the printer body. Alternatively, the time for replacing the revolver 4 may be based on how many times the cartridges 14 have been replaced. Specifically, each cartridge 14 is replaced with a new cartridge 14 when it runs out of toner. The revolver 4 may be replaced when the cartridges 14 are replaced the number of times associated with the number of guaranteed printings.

Figure 28:
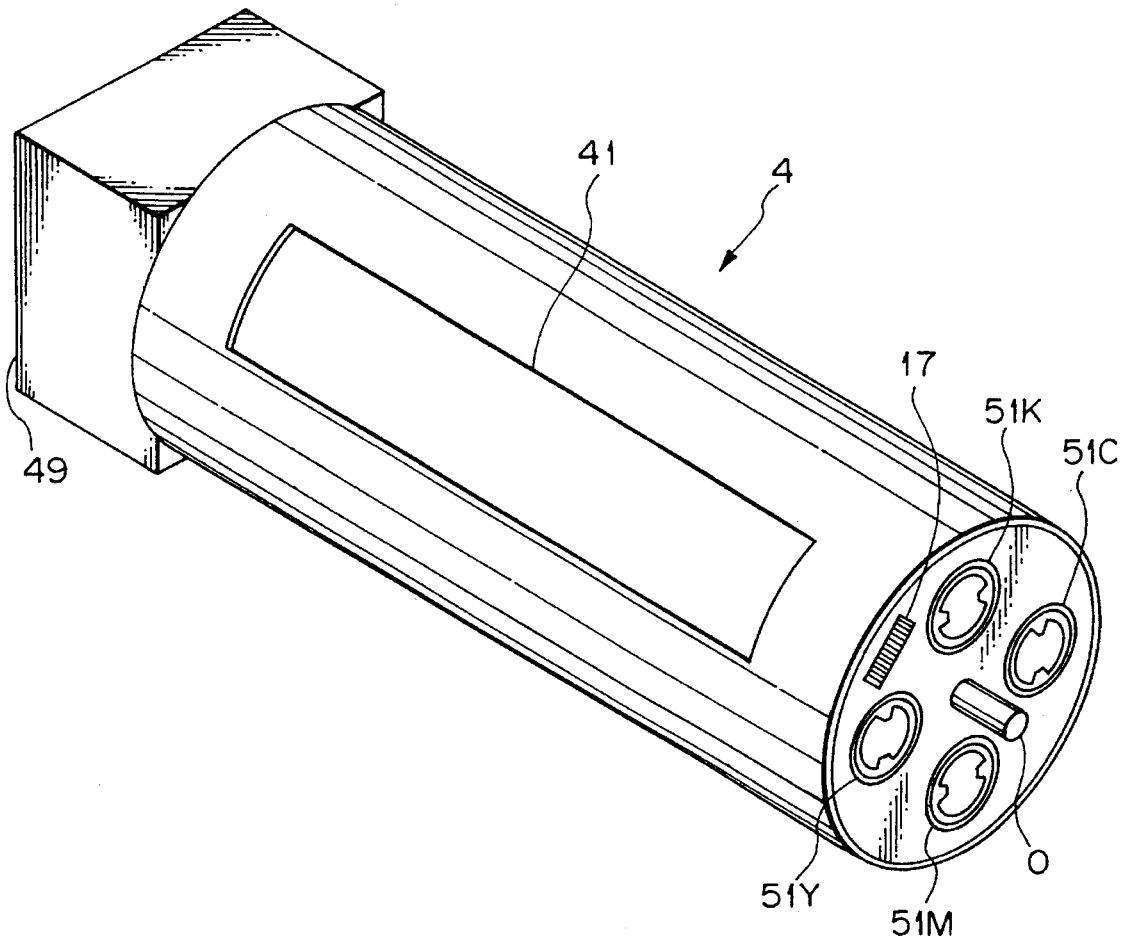
FIG. 28 shows a position where a bar code label is located.

When a new revolver 4, not storing any toner therein, is mounted to the printer body, no toner exists in the developing sections 42Y–42K. Hereinafter will be described an initial start-up mode, i.e., how toner is deposited on each side of the developing rollers 43Y–43K to enable the new revolver 4 to operate. To execute the initial start-up mode, the embodiment includes old/new distinguishing means and control means. The distinguishing means determines whether or not the revolver 4 mounted to the printer body is new and does not store any toner. When the revolver is new as determined by distinguishing means, the control means executes the initial start-up mode. As shown in FIG. 28, the sensing means is implemented as a bar code label 17 provided on the revolver 4 and representative of a reference position, and a bar code sensor 18 (not shown in FIG. 28) for reading the label 17. The bar code sensor 18 also plays the role of reference position sensing means during the course of usual image formation. Specifically, when the sensor 18 senses the label 17 after a sequence of image forming steps, the revolver 4 is brought to a stop and caused to wait for the next image formation.

Figure 29:
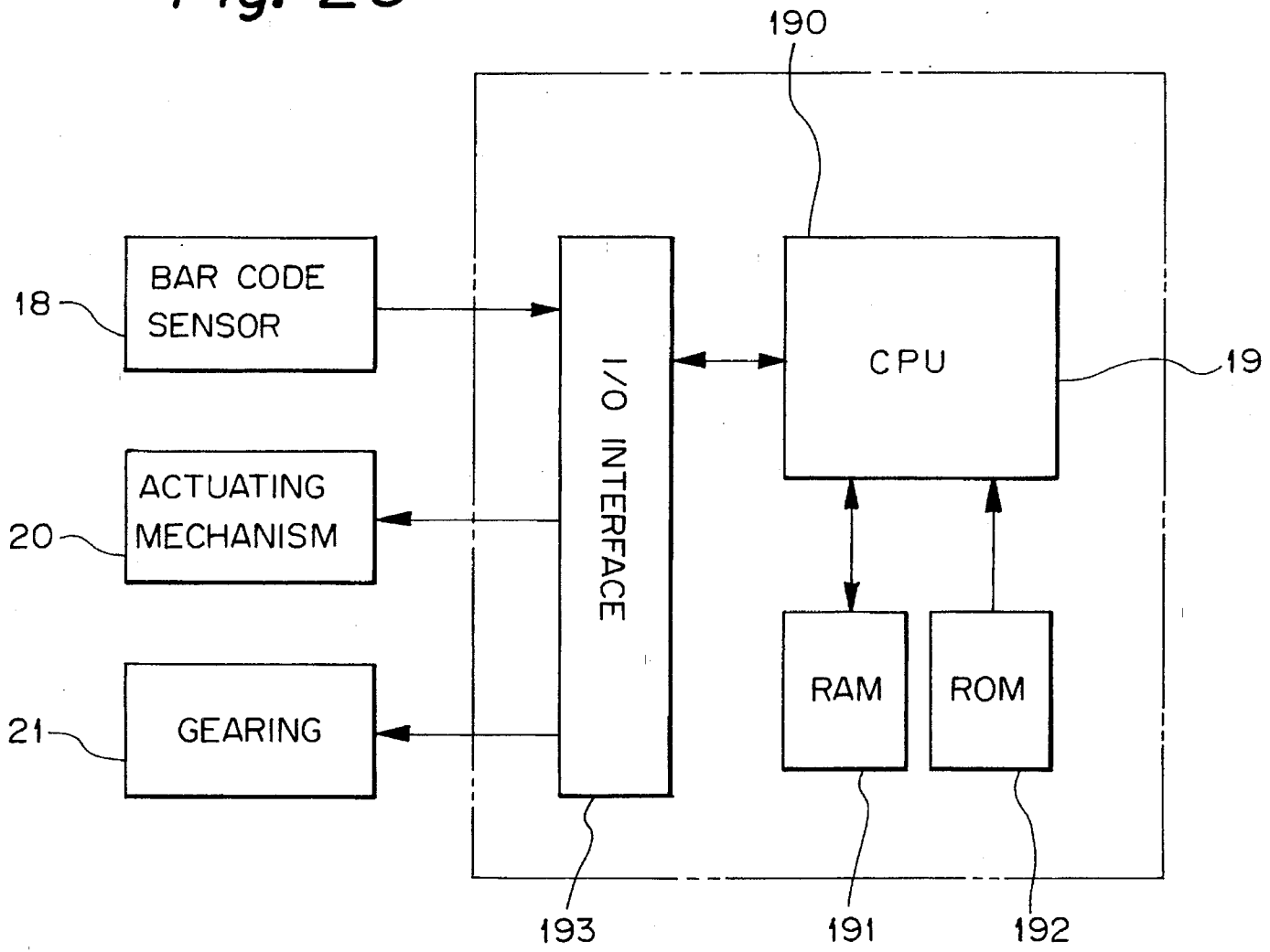
FIG. 29 is a block diagram schematically showing a control system included in the embodiment of FIG. 20.

A controller 19 controls the solenoid or similar actuating mechanism for the joint 15 and the gearing including gears and clutches. The controller 19 may be implemented by a controller built in the printer body. For example, as shown in FIG. 29, the controller 19 has a CPU (Central Processing Unit) 190, a RAM (Random Access Memory) 191, a ROM (Read Only Memory) 192, and an I/O (Input/Output) interface 193 connected to the above actuating mechanism 20 and gearing 21.

Figure 30:
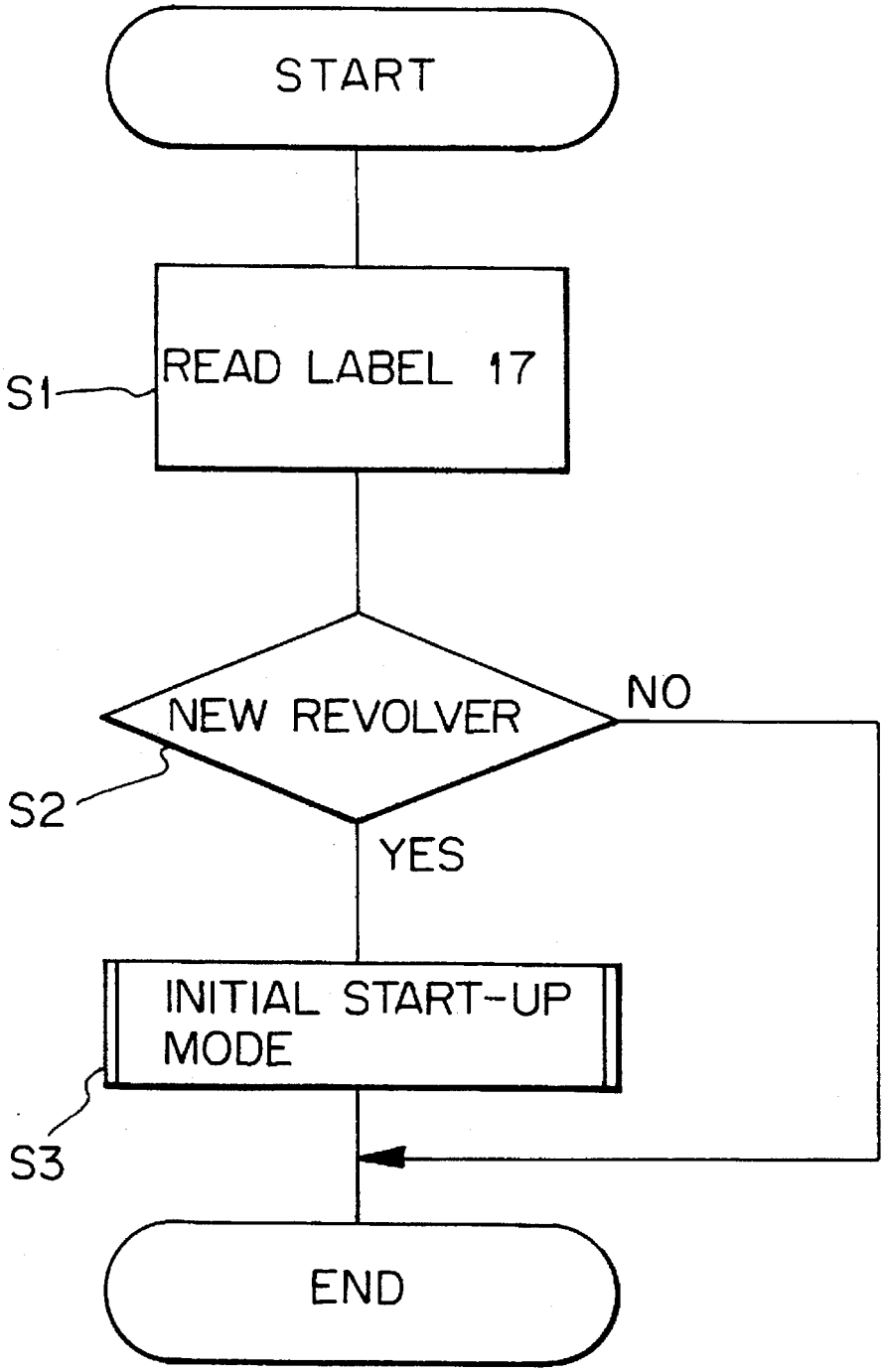
FIG. 30 is a flowchart demonstrating a procedure to be executed when a new rotary developing device is mounted to the color printer.

Referring to FIG. 30, the operation of the controller 19 will be described. As shown, when the revolver 4 is mounted to the printer body, the presence of the revolver 4 is detected by, for example, a microswitch, not shown. Then, the bar code sensor 18 reads the label 17 of the revolver 4 (step S1). On receiving the resulting data from the sensor 18, the controller 19 compares it with the previous data to see if the revolver 4 is new (step S2). If the input data differs from the previous data (YES, step S2), the controller 19 determines that a new revolver has been mounted on the printer body. The bar code label 17 of the revolver 4 has customarily been used to control lots in factories or similar facilities. In the embodiment, only if the label 17 is adhered to the revolver 4 at a reference position, it can serve as a reference position mark and the old/new distinguishing means at the same time. This kind of scheme, therefore, does not increase the cost of the printer.

When the revolver 4 is new as determined in the step S2, the initial start-up mode is selected (step S3). In this mode, the revolver 4 is moved to the reference position or home position and then revolved such that one of the developing sections, e.g., yellow developing section 42 arrives at the developing position. At this instant, the joint 15 is caused to slide, as shown in FIGS. 26A and 26B. In the start-up mode, the joint 15 slides more than during ordinary development shown in FIG. 26B. Specifically, as shown in FIG. 26C, the joint 15 slides to a position where it presses the coupling gear 51Y to the right, as viewed in the figure, against the action of the spring 55Y. As a result, the D-shaped hollow portion (not shown) of the gear 51Y is released from the D-shaped portion 45*b* of the supply roller shaft 45*a* and brought to a smaller diameter portion 45*c*. In this condition, the supply roller 45Y does not rotate despite the drive transmission to the gear 51Y via the joint 15. Further, the gears 51*a* and 51*b* of the gear 51Y are respectively released from the gears 52Y of the developing roller 43Y and the gear 54Y of the second screw 48Y. Hence, despite that the gear 51Y is rotated by the joint 15, neither the roller 43Y nor the screw 48Y rotates.

On the other hand, the gear 53Y of the first screw 47Y is so configured as to remain in mesh with the gear 50*e* even when the gear 51Y is pressed in the above direction. Hence, the driving force from the joint 15 is transferred only to the screw 47Y. As a result, only the screw 47Y rotates in the developing section 42Y. When the screw 47Y is continuously rotated for a predetermined period of time, the toner in the hopper 49Y is conveyed in the space G over the entire width of the developing unit 42Y. It is noteworthy that the conveyance of the toner over the entire width of the developing section 42Y completes in a short period of time (about one-third of the conventional period), compared to the ordinary development during which the developing roller 43Y and supply roller 45Y are also rotated. Specifically, during the ordinary development, the roller 45Y conveys the toner being conveyed by the screw 47Y and causes it to deposit on the roller 43Y or to drop into a collection space M (see FIG. 22). After the screw 47Y has conveyed the toner over the entire width of the section 42Y, the joint 15 is returned to the position shown in FIG. 26B. As a result, the rollers 45Y and 43Y are rotated. Therefore, the toner is fed to and deposited on the roller 43Y, rendering the developing section 42Y ready to operate.

The procedure described above is repeated with each of the other developing sections 42M–42K. Thereafter, the revolver is returned to the reference position. In this condition, the revolver 4 is ready to perform an ordinary image forming operation.

As stated above, when a new revolver 4 is mounted to the printer body, only the first screw 47 is rotated by the initial start-up mode. This prepares the revolver 4 for operation in a short period of time and thereby reduces the down time of the printer. In addition, the initial start-up mode makes it needless for the user to operate the revolver 4 for introducing each toner into a particular developing section 42.

Further, the embodiment determines whether or not the revolver 4 mounted to the printer body is new and does not store any toner, and executes, if it is new, the initial start-up mode automatically. This further saves time and labor, compared to a case wherein the user selects and executes such a mode by hand. Furthermore, the start-up mode is more surely executed than in the manual start-up scheme. In addition, the embodiment allows the revolver 4 not containing any toner to be transported and mounted to the printer body, thereby preventing the toner from flying out of a new revolver and freeing the operator's hands and cloths from smears.

While the embodiment drives only the first screw 47 in the initial start-up mode, only the screws 47 and 48 may be driven in the same configuration. This modification also achieves the advantages described above. In addition, the second screw 48 conveys toward the hopper 49 the toner conveyed by the first screw 47 and dropped in the circulating section 50. Hence, even if the toner is brought to the developing section 42 in an excessive amount due to the excessive duration of rotation of the screw 47, it is prevented from accumulating in a great amount in and around the circulating section 50 or from leaking to the outside of the section 42 while turning up the screen member 44.

In an alternative initial start-up mode available the embodiment, after the first screws 47 have respectively conveyed the toner of different colors over the entire widths of the developing sections 42Y–42K, preliminary development is effected. As a result, the toner of each color is deposited on one of the developing rollers 43Y–43K.

In summary, it will be seen that the present invention provides a rotary developing device having various unprecedented advantages as enumerated below.

(1) Guides are provided in each developer container and surely guide a powdery developer existing in the container toward an outlet. Hence, even when the amount of developer remaining in the container is small, it can be surely and entirely replenished into the hopper. This promotes the effective use of the developers and frees the operator from smears in the event of replacement of the containers.

(2) The developer moves in each developer container due to the revolution of the device or revolver. A step is formed between the surfaces of the container at the upstream side and downstream side with respect to the direction in which the developer moves. The step prevents the developer from passing an opening formed in the container and constituting a connecting portion. Therefore, when the amount of developer remaining in the container is small, it can be surely and entirely replenished into the hopper via the opening.

(3) Because the revolver is mounted to an apparatus body without being loaded with developer, there can be obviated the scattering of the developer out of a new revolver and the smearing of the operator's hands and cloths.

(4) Assume that an initial start-up mode stated earlier is selected after a new revolver has been mounted to the apparatus body. Then, only conveying means in each developing section is driven with a supply member held in operative. This prepares the revolver for operation in a short period of time and thereby reduces the down time of the printer. In addition, the initial start-up mode it needless for the user to operate the revolver for introducing each toner into a particular developing section.

(5) When the initial set-up mode is selected, not only a first conveying member but also a second conveying member are driven. Hence, even if the toner is brought to the developing section 42 in an excessive amount due to the excessive duration of rotation of the first member, it is circulated toward the hopper by the second member when reached the other end of the developing section. As a result, the developer is prevented from accumulating in the above-mentioned end or from leaking to the outside of the developing section.

(6) Whether or not the revolver mounted to the apparatus body is new and does not store any toner is determined. If the revolver is new, the initial start-up mode is automatically executed. This further saves time and labor, compared to a case wherein the user selects and executes such a mode by hand. Furthermore, the start-up mode is more surely executed than in the manual start-up scheme. In addition, the start-up procedure can be more surely executed, compared to the manual start-up scheme.

(7) New/old distinguishing means is implemented by a bar code label adhered to the revolver for identification, and bar code reading means for reading it. The distinguishing means is, therefore, simple and invites a minimum of increase in cost. A bar code label customarily used for lot control in factories or similar facilities may be used as the label for distinction in order to achieve a further cost-effective arrangement.

(8) A mark representative of the reference position of the revolver is implemented by a bar code label for the identification of the revolver. Reference position detecting means is provided and implemented as bar code reading means. With the reading means, it is easy to add information indicative of the reference position. In addition, the reading means can play the role of reference position sensing means at the same time. A bar code label customarily used for lot control in factories or similar facilities may be used as the label for distinction in order to achieve a further cost-effective arrangement.

(9) The revolver can be transported and replaced with ease.

Various modifications will become possible for those skilled in the art after receiving the teachings of the present disclosure without departing from the scope thereof.

What is claimed is:

1. A rotary developing device comprising:

a plurality of developing sections arranged around a rotary shaft;

a plurality of hoppers respectively constructed integrally with and communicated to said plurality of developing sections, and respectively storing powdery developers to be supplied to said plurality of developing sections;

a plurality of developer containers respectively removably mounted to and communicated to said plurality of hoppers, and respectively containing powdery developers to be replenished into said plurality of hoppers; and a plurality of guide portions respectively provided in said plurality of developer containers and for guiding, when said plurality of developing sections are revolved, said powdery developers to outlets respectively formed in said plurality of toner container;

wherein said plurality of developing sections are revolved around said rotary shaft until any one of said developing sections reaches a developing section where said one developing section faces an image carrier, while said powdery developer is replenished from one of said plurality of developer containers into said respective hopper due to revolution of said developing sections.

2. A device as claimed in claim 1, wherein said powdery developer is replenished from said respective developer container into said respective hopper via a connecting portion connecting said developer container to said hopper during the revolution of said developing sections.

3. A device as claimed in claim 2, wherein an inner surface of said respective developer container located at a downstream side, with respect to a direction in which said powdery developer moves in said developer container toward an opening constituting said connecting portion during the revolution of said developing sections, is protruded into said developer container relative to an inner surface located at an upstream side with respect to said direction.

4. A rotary developing device comprising:

a plurality of developing sections arranged around a rotary shaft;

a plurality of hoppers respectively constructed integrally with said plurality of developing sections, and respectively communicated to said plurality of developing sections in a lengthwise direction of said developing sections, and each storing a powdery developer to be supplied to said respective developing section;

a supply member for supplying a developer carrier with a developer from a first conveying region for supply formed in the lengthwise direction of each of said plurality of developing sections; and conveying means for conveying said developer from said respective hopper to said respective first conveying region, and for returning to said respective hopper a developer collected in a second conveying region for collection, which is separated from said first conveying region, without being deposited on said developer carrier;

wherein said plurality of developing sections are revolved around said rotary shaft until one of said developing sections reaches a developing position where said one developing section faces an image carrier, and wherein said device is operable in an initial start-up mode for driving said conveying means, while maintaining said supply member inoperative, such that said developer replenished into said respective hopper is conveyed over an entire dimension of said first conveying region.

5. A device as claimed in claim 4, wherein said device is removably mounted to a body of an image forming apparatus.

6. A device as claimed in claim 4, wherein said conveying means comprises:

a first conveying member for conveying said developer from said respective hopper to an end of said respective developing section opposite to said one end in a lengthwise direction of said first conveying region; and a second conveying member for returning said developer conveyed by said first conveying member to said other end and said developer collected in said second conveyance region to said one end.

7. A device as claimed in claim 6, wherein only said first conveying member is driven when said conveying means is driven in said initial start-up mode.

8. A device as claimed in claim 4, wherein said conveying means comprises:

a first conveying member for conveying said developer from said respective hopper to an end of said respective developing section opposite to said one end in a lengthwise direction of said first conveying region; and a second conveying member for returning said developer conveyed by said first conveying member to said other end and said developer collected in said second conveying region to said one end.

9. A device as claimed in claim 8, wherein said first conveying member and said second conveying member are driven when said conveying means is driven in said initial start-up mode.

10. An image forming apparatus comprising:

a rotary developing device comprising a plurality of developing sections arranged around a rotary shaft, and for effecting development by revolving said plurality of developing sections until any one of said developing sections reaches a developing position where said one developing section faces an image carrier, said developing device being removably mounted to a body of said image forming apparatus;

distinguishing means for determining whether or not said developing device mounted to said image forming apparatus is new and contains no developers in said plurality of developing sections, wherein said distinguishing means comprises a bar code label adhered to said developing device for identification, and bar code reading means for reading said bar code label; and means for controlling supplying developer to said developing device based on whether said developing device is distinguished to be new.

11. An image forming apparatus comprising:

a rotary developing device comprising a plurality of developing sections arranged around a rotary shaft, and for effecting development by revolving said plurality of developing sections until any one of said developing sections reaches a developing position where said one developing section faces an image carrier, said developing device being removably mounted to a body of said image forming apparatus;

a mark indicative of a reference position of said developing device including a bar code label representative of information for identification and adhered to said developing device;

sensing means responsive to said reference position including bar code reading means capable of reading said bar code label; and means for controlling supplying developer to said developing device based on an output of said sensing means.

* * * * *